US006657191B2

(12) United States Patent
Park

(10) Patent No.: US 6,657,191 B2
(45) Date of Patent: Dec. 2, 2003

(54) MEANS AND METHOD FOR MULTIPLEXING SPRAYS IN AN ELECTROSPRAY IONIZATION SOURCE

(75) Inventor: Melvin A. Park, Billerica, MA (US)

(73) Assignee: Bruker Daltonics Inc., Billerica, MA (US)

( * ) Notice: Subject to any disclaimer, the term of this patent is extended or adjusted under 35 U.S.C. 154(b) by 333 days.

(21) Appl. No.: 09/798,785

(22) Filed: Mar. 2, 2001

(65) Prior Publication Data

US 2002/0121598 A1 Sep. 5, 2002

(51) Int. Cl.[7] ..... H01J 49/04; H01J 49/10

(52) U.S. Cl. ..... 250/288; 250/287; 250/281; 250/283

(58) Field of Search ..... 250/288, 287, 250/281, 283

(56) References Cited

U.S. PATENT DOCUMENTS

| | | | | |
|---|---|---|---|---|
| 2,534,181 A | | 12/1950 | Roberts | |
| 3,802,782 A | | 4/1974 | Natelson | |
| 4,004,150 A | | 1/1977 | Natelson | |
| 4,051,731 A | | 10/1977 | Bohl et al. | |
| 4,840,074 A | | 6/1989 | Jessop | |
| 5,288,514 A | | 2/1994 | Ellman | |
| 5,449,902 A | | 9/1995 | Onishi et al. | |
| 5,668,370 A | | 9/1997 | Yano et al. | |
| 5,756,994 A | | 5/1998 | Bajic | |
| 5,792,663 A | * | 8/1998 | Fry et al. | 436/73 |
| 5,798,032 A | * | 8/1998 | Khan et al. | 204/452 |
| 5,993,633 A | * | 11/1999 | Smith et al. | 204/601 |
| 6,066,848 A | | 5/2000 | Kassel et al. | |
| 6,127,680 A | * | 10/2000 | Andrien et al. | 250/288 |
| 6,191,418 B1 | * | 2/2001 | Hindsgaul et al. | 250/288 |

FOREIGN PATENT DOCUMENTS

| | | |
|---|---|---|
| EP | 0 966 022 A2 | 12/1999 |
| WO | WO 99/13492 | 3/1999 |
| WO | WO 99/50667 | 10/1999 |

OTHER PUBLICATIONS

R. Bateman et al., "Multiple LC/MS; Parallel and Simultaneous Analyses of Liquid Streams by LC/TOF Mass Spectrometry Using a Novel Eight–Way Interface", American Society for Mass Spectrometry, 1998.

L. Jiang and M. Moini, "Development of Multi–ES–I–Sprayer, Multi–Atmospheric–Pressure–inlet Mass Spectrometry and Its Application to Accurate Mass Measurement Using Time–of–Flight Mass Spectrometry", Anal. Chem., 20–24, 72 (1), (2000).

(List continued on next page.)

*Primary Examiner*—John R. Lee
*Assistant Examiner*—K Fernandez
(74) *Attorney, Agent, or Firm*—Ward & Olivo

(57) ABSTRACT

A means and method are disclosed for multiplexing a plurality of samples from multiple sprayer devices to be efficiently transferred to a mass analyzer for subsequent analysis. Sample sprays are formed from a plurality of sprayers, which are desolvated to form the sample ions. The sample ions are then selected from one of the sprayers for transportation into a mass analyzer. To accomplish this, the apparatus of the invention comprises a multi-part capillary wherein a first section thereof is connected to a motor which is able to move this first section from one sprayer to the next. This first section may be a flexible tube-like structure loosely mounted in an aperture of a cone-shaped end of a motor which rotates such that the sampling orifice may be aligned with different sprayers at different times to sequentially and repetitively sample ions produced by each of the plurality of sprayers.

71 Claims, 12 Drawing Sheets

OTHER PUBLICATIONS

L. Zeng and D. B. Kassel, "Development of a Fully Automated Parallel HPLC/Mass Spectrometry System for the Analytical Characterization and Preparative Purification of Combinatorial Libraries," Anal. Chem., 4380–4388, 70 (20), (1998).

C. Eckers et al., "Exact mass LC–MS and MS/MS on orthogonal time–of–flight mass analyzers using automated rapid switching between separate sample and reference sprays," 1999 ASMS Conference Abstracts, ThOC; LC/MS Instrumentation and Methods; Slot 11:15, (1999).

* cited by examiner

MEANS AND METHOD FOR MULTIPLEXING SPRAYS IN AN ELECTROSPRAY IONIZATION SOURCE

TECHNICAL FIELD OF THE INVENTION

The present invention relates generally to means and method whereby ions may be transferred efficiently from an ion source to a mass analyzer. More specifically, an apparatus and method are described for multiplexing sprays (i.e., using multiple sprays) in an electrospray ionization source. The methods for transferring ions described herein are enhancements of the techniques that are referred to in the literature relating to mass spectrometry.

BACKGROUND OF THE PRESENT INVENTION

Mass spectrometry is an important tool in the analysis of a wide range of chemical compounds. Specifically, mass spectrometers can be used to determine the molecular weight of sample compounds. The analysis of samples by mass spectrometry consists of three main steps-formation of gas phase ions from sample material, mass analysis of the ions to separate the ions from one another according to ion mass, and detection of the ions. A variety of means exist in the field of mass spectrometry to perform each of these three functions. The particular combination of means used in a given spectrometer determine the characteristics of that spectrometer.

To mass analyze ions, for example, one might use a magnetic (B) or electrostatic (E) analyzer. Ions passing through a magnetic or electrostatic field will follow a curved path. In a magnetic field the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), and the quadrupole ion trap analyzers.

Before mass analysis can begin, however, gas phase ions must be formed from sample material. If the sample material is sufficiently volatile, ions may be formed by electron impact (EI) or chemical ionization (CI) of the gas phase sample molecules. For solid samples (e.g. semiconductors, or crystallized materials), ions can be formed by desorption and ionization of sample molecules by bombardment with high energy particles. Secondary ion mass spectrometry aft) (SIMS), for example, uses keV ions to desorb and ionize sample material. In the SIMS process a large amount of energy is deposited in the analyte molecules. As a result, fragile molecules will be fragmented. This fragmentation is undesirable in that information regarding the original composition of the sample—e.g., the molecular weight of sample molecules—will be lost.

For more labile, fragile molecules, other ionization methods now exist. The plasma desorption (PD) technique was introduced by Macfarlane et al. in 1974 (Macfarlane, R. D.; Skowronski, R. P.; Torgerson, D. F., *Biochem. Biophys. Res Commun.* 60 (1974) 616). Macfarlane et al. discovered that the impact of high energy (MeV) ions on a surface, like SIMS would cause desorption and ionization of small analyte molecules, however, unlike SIMS, the PD process results also in the desorption of larger, more labile species—e.g., insulin and other protein molecules.

Lasers have been used in a similar manner to induce desorption of biological or other labile molecules. See, for example, Van Breeman, R. B.: Snow, M.: Cotter, R. J., *Int. J. Mass Spectrom. Ion Phys.* 49 (1983) 35; Tabet, J. C.; Cotter, R. J., *Anal. Chem.* 56 (1984) 1662; or Olthoff, J. K.; Lys, I.: Demirev, P.: Cotter, R. J., *Anal. Instrument.* 16 (1987) 93. Cotter et al. modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (Tanaka, K.; Waki, H.; Ido, Y.; Akita, S.; Yoshida, Y.; Yoshica, T., *Rapid Commun. Mass Spectrom.* 2 (1988) 151 and Karas, M.; Hillenkamp, F., *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process, MALDI, is typically used in conjunction with time-of-flight mass spectrometry (TOFMS) and can be used to measure the molecular weights of proteins in excess of 100,000 daltons.

Atmospheric pressure ionization (API) includes a number of methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. Very large ions can be formed in this way. Ions as large as 1 MDa have been detected by ESI in conjunction with mass spectrometry (ESMS).

ESMS was introduced by Yamashita and Fenn (M. Yamashita and J. B. Fenn, *J. Phys. Chem.* 88,4671,1984). To establish this combination of ESI and MS, ions had to be formed at atmospheric pressure, and then introduced into the vacuum system of a mass analyzer via a differentially pumped interface. The combination of ESI and MS afforded scientists the opportunity to mass analyze a wide range of samples. ESMS is now widely used primarily in the analysis of biomolecules (e.g. proteins) and complex organic molecules.

In the intervening years a number of means and methods useful to ESMS and API-MS have been developed. Specifically, much work has focused on sprayers and ionization chambers. In addition to the original electrospray technique, pneumatic assisted electrospray, dual electrospray, and nano electrospray are now also widely available. Pneumatic assisted electrospray (A. P. Bruins, T. R. Covey, and J. D. Henion, Anal. Chem. 59, 2642, 1987) uses nebulizing gas flowing past the tip of the spray needle to assist in the formation of droplets. The nebulization gas assists in the formation of the spray and thereby makes the operation of the ESI easier. Nano electrospray (M. S. Wilm, M. Mann, *Int. J. Mass Spectrom. Ion Processes* 136, 167, 1994) employs a much smaller diameter needle than the original electrospray. As a result the flow rate of sample to the tip is lower and the droplets in the spray are finer. However, the ion signal provided by nano electrospray in conjunction with MS is essentially the same as with the original electrospray. Nano electrospray is therefore much more sensitive with respect to the amount of material necessary to perform a given analysis.

Furthermore, High performance liquid chromatography ("HPLC") in combination with mass spectrometry has become an important tool in the analysis of a wide range of chemical and biological samples. When using conventional HPLC the time typically required for the elution of a given sample component (i.e., the time from when it starts to come out of the column to when it finished coming out of the column) is typically a few seconds. However, the time required to mass analyze a compound is much shorter (0.1 seconds or less). When using TOF mass analysis, the time needed to produce a mass spectrum may be as little as 0.01 seconds. As a result, one may, in principle, analyze the effluent from a number of columns simultaneously.

For example, FIG. 1 depicts a method and apparatus for multiplexing four spray needles 12, 14, 16 & 18 in an electrospray ionization source according to Kassel et al. U.S. Pat. No. 6,066,848 ("Kassel"). As described in Kassel, effluent from four HPLC columns 2, 4, 6 & 8 is injected into spray needles 12, 14, 16 & 18. The electrospray and subsequent ions produced by sprayers 12, 14, 16 & 18 are accelerated towards plate 36 by a potential between spray needles 12, 14, 16 & 18 and plate 36 and plate 38. Plate 36 includes aperture 32 located in an off-center position. During use plate 36 is rotated about its center (as indicated by arrows 34) and aperture 32 is aligned sequentially with spray needle 12, spray needle 16, spray needle 18, and spray needle 14, in turn. Ions produced by the sprayer aligned with aperture 32 pass through aperture 32 and on to orifice 20. These ions pass through orifice 20 and into mass spectrometer 10. In mass spectrometer 10, the ions are analyzed to determine their mass and abundance. As disk 36 is rotated, ions from the different sprayers (and the different HPLC columns) are sampled and mass spectra are produced—one mass spectrum for each spray needle 12,14, 16 & 18 per each rotation of disk 36. The mass spectra may then be labeled electronically so as to associate the mass spectra with the sprayer (and HPLC column) from which they originate.

As described in Kassel, plate 36 serves as a "blocking" device, which moves in order to block the sample spray from all but one of spray needles 12, 14, 16 & 18 at any given time. Such a method and apparatus for multiplexing sample sprays has disadvantages. First, sampling orifice 20 is maintained in a fixed position with respect to spray needles 12, 14, 16 & 18. In such an arrangement, optimum conditions cannot be satisfied for each individual sprayer position with respect to the sampling orifice. Rather, an optimum geometry between sampling orifice 20 and all sprayers as a whole is optimized. Second, because plate 36 merely serves as a "blocking" device, significant portions of the sample spray is wasted (or lost) during each analysis (i.e., any sample spray that is blocked by plate 36 and does not pass through aperture 32).

Other techniques to sample ions from multiple ion sprayers are also known. One such method, similar to Kassel, as shown in FIG. 2, is an eight-way multiplexed electrospray inlet as disclosed by Robert Bateman et al., "Multiple LC/MS: Parallel and Simultaneous Analyses of Liquid Streams by LC/TOF Mass Spectrometry Using a Novel Eight-Way Interface", American Society for Mass Spectrometry, 1998 ("Bateman"). Bateman discloses sampling cone 66 surrounded by rotating cylinder 68 (e.g., in a manner shown by arrow 74) having apertures 64 & 65 and sprayers 42,44,46, 48, 50, 52, 54 and 56 evenly spaced in an arc around cylinder 68. When sprayed, the sample droplets travel through aperture 64 or 65 (i.e., depending on which aperture is positioned in front of the spraying sprayer) to sampling cone 66, which is at the center of cylinder 68. Unlike Kassel (FIG. 1), rather than using a blocking plate (or disk), Bateman teaches a rotating cylinder 68 having apertures (64 & 65) for allowing the sample spray to pass therethrough and into sampling cone 66. Sampling cone 66 then transfers ions from atmospheric pressure region of source block 40 into a vacuum system of mass spectrometer 70, as indicated by arrow 72. Again, as disclosed in Kassel, the method and apparatus disclosed by Bateman uses a "blocking" device to prevent unwanted sample from entering the mass analyzer at a given point in time.

Also, methods for sampling solutions from different sprayers without using a multiplexing technique are known. For example, FIG. 3 depicts a multi-ESI-sprayer, multi-nozzle time-of-flight mass spectrometer as disclosed in Longfei Jiang and Mehdi Moini, "Development of Multi-ESI-Sprayer, Multi-Atmospheric-Pressure-inlet Mass Spectrometry and Its Application to Accurate Mass Measurement Using Time-of-Flight Mass Spectrometry", *Anal. Chem.* 72, 20 (2000) ("Jiang"). An elevated pressure ion source always has an ion production region (wherein ions are produced) and an ion transfer region (wherein ions are transferred through differential pumping stages and into the mass analyzer). Typically, the ion production region is at an elevated pressure—most often atmospheric pressure—with respect to the analyzer. Disclosed in Jiang is the use of a multitude of sprayers 14 with two differential pumping stages 90 & 96. Ions from different solutions (e.g., ESI samples such as reference compound 76, CE sample 78 and LC samples 80 & 82) are transferred from atmospheric pressure to a first differential pumping region 90 by gas flow via quadruple nozzle 84. Quadruple nozzle 84 comprises multiple sprayers at its exit end to eject ions from the different solutions in paths 86, 88, 92 & 94 aimed at an aperture in pressure restriction 98 (e.g., a skimmer), which transfers the ions from first pumping region 90 to second pumping region 96. An electric field applied across the exit end of quadruple nozzle 84 and restriction 98 as well as gas flow assist in the transfer of ions between these regions. Second differential pumping region 96 includes multipole 101 (comprising rods 102, 104, 106 & 108) which accepts ions of a selected mass/charge (m/z) ratio and guides them through second pressure restriction 100 and into TOF mass spectrometer 110.

Turning next to FIG. 4, shown is a prior art multiple needle electrospray apparatus for a mass spectrometer according to PCT Application No. PCT/CA99/00264 by applicant Synsorb Biotech, Inc., entitled "Electrospray Device For Mass Spectrometer" ("Synsorb"). As depicted, Synsorb's multiple needle electrospray apparatus includes a plurality of electrospray needles 120 mounted on a rotatable plate 112 for sequential injection of multiple sample streams. The rotatable electrospray apparatus allows collection of data from multiple sample streams by a single mass spectrometer 128 in a short time by rotating the electrospray apparatus to sequentially monitor the stream from each of the needles 120 for a brief duration before rotating the plate 112 to another of the needles.

According to one method for screening compound libraries which involve analysis of multiple sample streams by electrospray mass spectrometry, a compound library is prepared, such as by combinatorial chemistry techniques. Multiple sample streams each of which contain a compound library or sub-library are passed through a plurality of frontal chromatography columns. Each stream is passed through a single column to analyze the interaction of members of that sample stream with a target receptor within the column. The columns include a solid support or inert material on which the target receptor is bound or coupled. As the sample stream is continuously infused through the chromatography column. those compounds within the sample stream having a higher affinity for the target receptor (i.e., lipands) will be more strongly bound to the target receptors. When a compound has reached equilibrium with the column. it will break through and begin to pass out of the column with those compounds having the lowest affinity passing out of the column first. The sample streams exiting the chromatography columns are analyzed by electrospray mass spectrometry to determine the break through time for each compound. Mass spectrometry is particularly useful for this process because it allows for both detection and identification of the library members present in the sample streams exiting the columns.

FIG. 4 illustrates a prior art electrospray device for delivery of multiple liquid sample streams to a mass spectrometer according to Synsorb. The electrospray device includes electrospray chamber 114 for charging the droplets of a sample stream delivered by electrospray needles 120 and delivering the charged ions in a beam to mass spectrometer 128.

Electrospray needles 120 each have an upper end mounted on rotatable plate 112 in the circular arrangement. The lower ends of the electrospray needles may be rotated into a reproducible delivery position within electrospray chamber 114. The delivery position is at a precise location with respect to orifice 122 of mass spectrometer 128 which allows the sprayed droplets to be focused into a beam passing through orifice 122. The delivery position is within about ±0.5 mm of an ideal position in fluid connection with each of the electrospray needles 120 is a sample source such as chromatography columns 118 illustrated in FIG. 1. The chromatography columns 118 are mounted on the top of the rotatable plate 112 or are connected to the needles 120 with flexible lines.

Electrospray chamber 114 surrounds orifice 122 of the mass spectrometer and is open to atmospheric pressure, while surrounding needles 120 for containment purposes. Only needle 120 placed closest to a delivery position experiences a sufficiently high electric field and proximity for the efficient transmission of gas phase ions into the mass spectrometer 128. Further, electrospray needles 120 are coaxial needles which deliver the sample stream through an inner needle lumen and deliver a nebulizer gas, such as nitrogen, coaxially around the sample stream to break up the flow of the sample stream into a spray of droplets. Alternatively, the needles 120 may be single lumen needles delivering only the sample stream. The electrospray chamber 114 includes a charged sampling plate 116 surrounding the mass spectrometer entry orifice 122. The electrospray chamber 114 can also include an electrode 126 in the form of a half cylindrical member. The charged sampling plate 116 and half cylindrical electrode 126 are charged with an electric potential preferably of about 0 to 6000 volts. The electric field established by the sampling plate 116 and the electrode 126 surrounds the grounded needle 120 and imparts a charge to the sprayed droplets.

Alternatively, the charging of the sample stream droplets exiting electrospray needle 120 may be accomplished by use of a charged electrospray needle, biased sampling plate 116, and no electrode 126. The needle 120 may be continuously charged or may be charged only when the needle reaches the delivery position within electrospray chamber 114 by an electrical contact.

A counter current drying gas. such as nitrogen, is delivered to the electrospray chamber 114 through passageway 124 between charged sampling plate 116 and entry orifice 122 to assist in desolvating or evaporating the solvent from the sample stream to create fine droplets. Optionally, the drying gas may be delivered to electrospray chamber 114 in manners other than through passageway 124. In addition, the nebulizer gas may be delivered to the electrospray chamber 114 separately rather than by a co-axial flow through the electrospray needle. Both the nebulizer gas and the drying gas are introduced into the electrospray chamber 14 to obtain fine droplets of the sample stream. However, depending on the flow rate of the sample stream, the fine droplet size may be achieved without the need for a nebulizer gas and/or a drying gas.

The rotatable plate 112 is rotated by a motor connected to a drive shaft. The motor is interfaced with a controller to control the rotation of the plate and the dwell times for each of the needles.

During operation, multiple sample streams are continuously delivered to each of the chromatography columns 118 from sample sources by, for example, a pump, such as a syringe pump. The sample streams exiting columns 118 may be combined with a diluent in a mixing chamber or mixing tee 138 positioned between the column and needle 120. The sample streams pass continuously through electrospray needles 120 with a nebulizer gas delivered around the sample streams to break up the flow into droplets. In one disclosed embodiment, sample streams pass through all of the needles 120 simultaneously with only one of the streams from a needle positioned at the delivery position being analyzed by the mass spectrometer at a time. The sample streams from the remaining needles 120 are optionally collected by a tray 130 for delivery to waste.

To perform analysis of the multiple sample streams, Synsorb provides that rotatable plate 112 is stepped in one direction (e.g., counter clockwise), through approximately half of the needles 120. When a quadrupole mass spectrometer is used, a dwell time for each electrospray needle 120 ranges from about 0.5 to 10 seconds, preferably about 1 to 5 seconds before switching to the next column. After analysis of approximately half the sample streams, the rotatable plate 112 then returns clockwise to a home position and begins stepping in an opposite direction (e.g., clockwise), through the remaining half of needles 120. Finally, rotatable plate 112 returns again to the home position and repeats the procedure. The system operates continuously for a preset period of time related to the chromatographic requirements. Step times for rotation between successive needles is preferably less than about 100 msec, more preferably less than about 10 msec. The rotation of plate 112 in one direction followed by reversing the rotation is preferred to prevent the feed lines for feeding the sample streams from the pump to columns 118 from becoming twisted.

Alternatively, the sample source, the pump or alternative, and the feed lines for delivery of the sample streams to columns 118 may be mounted on plate 112. With this embodiment, plate 112 may be rotated continuously in one direction to sequentially analyze the flows from each of the needles without requiring the plate to reverse direction and return to a home position.

This multiple needle electrospray apparatus is described for use with any of the known mass spectrometers including a quadrupole mass spectrometer, quadrupole ion trap mass spectrometer, Penning or Paul ion trap mass spectrometer, FTICR (Fourier transform inductively coupled resonance) mass spectrometer, TOF mass spectrometer, and the like. A TOF mass spectrometer is preferred due to its high spectral acquisition rate (>100 spectra per second). However, the slower quadrupole mass spectrometer may also be used which can record spectra at a rate of approximately 0.5 to 1 per second. The dwell times for analysis of each sample stream will vary depending on the spectral acquisition of the mass spectrometer used.

Synsorb also discloses the use of different numbers of electrospray needles depending on the number of sample streams which are to be analyzed. The spacing of the multiple electrospray needles 120 is important to the operation of the electrospray device. In particular, electrospray needles 120 should be spaced sufficiently to prevent cross over effects resulting from the sample stream from one columns influencing the analysis of the sample stream of an adjacent column. In addition, electrospray needles 120 should be spaced as close together as possible to minimize the step times for rotation between adjacent needles. Preferably, the spacing between columns should be about 0.5 cm to 10 cm, depending on the mass spectrometer used. Alternatively, physical blocking members may be used to prevent cross over effects and allow closer needle placement. Next, FIG. 5 shows a top view of another rotatable electrospray apparatus for delivery of sample streams to a mass spectrometer 140 according to Synsorb. The electrospray apparatus includes a plurality of electrospray needles 142 mounted in a radial arrangement on a rotatable plate 144. Each of the needles 142 are in fluid connection with a chromatography column 146. The radial arrangement of the electrospray needles 142 allows more columns 146 to be positioned on a rotatable plate 144 of a smaller diameter. According to this embodiment, the discharge ends of the needles 142 are preferably spaced a distance sufficient to prevent a cross over effect between adjacent needles. However, the columns 146 can be arranged close together around the periphery of the rotatable plate 144.

The present invention is distinguished from prior art by providing two distinct advantages. First, the preferred embodiment allows the use of heated drying gas and an endcap for efficient drying of sprayed droplets. Second, the sampling orifice of the multiple part capillary is, in the preferred embodiment, moved to an optimum position for the sampling of ions from a given sprayer, while in prior art designs, the sampling orifice was in a fixed position (not necessarily the optimum for any given sprayer). A result of this configuration (i.e., having a movable "sampling orifice") is that the sampling orifice may be positioned closer to the sprayer, allowing use of a wider variety of spray devices, such as nanosprayers, microsprayers, which cannot be used with the prior art multiplexing devices.

The present invention further distinguishes itself from prior art by providing a means and method for simpler, more efficient, multiplexed sample introduction into an ESI mass spectrometer. According to prior art multiplexing apparatuses and methods, first, a sample spray is formed from the plurality of sprayers. Second, the device selects the specific sprayer from which to accept the sample spray. Third, the droplets from the sample spray are desolvated in an electric field wherein sample ions are formed. Fourth, the sample ions are transported into a mass spectrometer. This sequence of spraying, selecting, desolvating, and then transporting the sample ions has significant limitations and disadvantages. For example, the prior art multiplexing devices cannot be used adequately with nano- or micro-electrospray sources because the sampling orifice cannot be brought close enough to the sprayer(s). Also, the prior art cannot utilize different types of sprayers (i.e., electrospray, pneumatic spray, etc.) simultaneously. That is, electrospray (specifically, nanospray) cannot be used with drying gas while drying gas is needed for pneumatic sprayers. The prior art multiplexing designs do not function such that drying gas may be used with only some of the plurality of sprayers—it must be used with all or none. Further, in the prior art multiplexing devices, optimum conditions for maximum performance cannot be obtained for each sprayer independently—only a compromised arrangement may be obtained.

In contradistinction, the present invention uses a multiple section capillary device, which allows the orifice of the entrance to a mass analyzer to be moved (e.g., rotated) so as to sequentially sample ions from a series of ESI sprayers. The use of such an apparatus to multiplex samples from a plurality of sprayers necessarily provides a distinct and improved method of such sampling. Some of the distinct advantages provided by the present invention include use with nano- or micro-electrospray sources since the sampling orifice may be positioned at any distance from the sprayer(s) desired, the ability to simultaneously utilize any number of different types of sprayers (i.e., electrospray, pneumatic spray, etc.), and the ability to optimize the conditions for maximum performance and resolution for each sprayer, independently—a significant improvement over the prior art devices. Also, optionally, the use of an endcap electrode and drying gas in conjunction with a multiplexed sampling apparatus may be used to enhance the performance of an ESI/HPLC source for a mass spectrometer.

SUMMARY OF THE INVENTION

The present invention provides an improved method and apparatus for the multiplexing of samples from a plurality of sources. The essential feature of the present invention, which provides a means and method for multiplexing sprays in an electrospray ionization source, is a multiple part (or section) capillary. The first section, the section receiving ions from the source, is preferably flexible (e.g., made of a polymer) in order that its entrance end (i.e., comprising a sampling orifice) may be moved to sample different sprays. In one embodiment of the present invention, a sampling device (e.g., conical) is mounted on a motor (e.g., a step motor).

The sampling device comprises a single aperture in which the entrance end of the capillary's first section is loosely attached to allow it to rotate therein, while the opposing end is affixed by a union to the second section of the capillary. This single aperture is positioned such that when the sampling device is rotated to a first position, its single aperture is aligned with a first sprayer such that ions produced by the first sprayer may pass through the aperture and into the entrance end of the capillary. Then, the sampling device may be rotated (either smoothly or in a stepped manner) to a second position aligning the single aperture with a second sprayer, and so on.

The described apparatus may be used with any number of sprayers. Thus, the sampling orifice of the capillary can sequentially and repetitively sample the ions produced by a plurality of sprayers. Optionally, an endcap may be added between the sprayer and the sampling device to direct a heated drying gas toward the sprayers so that droplets produced by the sprayers are caused to evaporate, thereby forming ions. The use of heated drying gas is particularly important for the efficient production of ions at high sample flow rates, such as in HPLC analyses. Further, the endcap helps define the electric field between the sprayers and the capillary orifice (and the associated sampling device). Also, because the endcap is fixed (i.e., it does not rotate with the sampling device), it has apertures aligned with each sprayer (i.e., one aperture per sprayer) such that drying gas flows continuously from the heater around the sampling device and through the apertures towards the sprayers.

The invention herein described provides an improved method for multiplexing a plurality of samples. More specifically, the process of multiplexing the plurality of samples includes first, forming a sample spray from the plurality of sprayers. Second, the droplets from the sample spray are desolvated in an electric field wherein sample ions are formed. Then, third, the device selects the specific sprayer from which to accept the sample spray. Fourth, and finally, the sample ions are transported into a mass spectrometer. This sequence of spraying, desolvating, selecting, and then transporting the sample ions provides significant improvements and advantages over the prior art multiplexing devices.

It is an object of the invention to provide an improved multiplexing source using a multiple section capillary device such that the sampling orifice of the entrance to a mass analyzer may be positioned so as to sequentially sample ions from a series of ESI sprayers, which further permits the sampling orifice to be positioned at the optimum distance from each sprayer to thereby maximize performance and resolution of the mass analyzer.

Another object of the invention is to provide a improved method of multiplexing samples from a plurality of sprayers (either all of the same type or each of a different type or any combination thereof) wherein the sample is first sprayed, the sample spray is then desolvated to form sample ions, which are next selected by the positioning of the sampling orifice, and finally transported into the mass analyzer. The use of such a method and apparatus to multiplex samples from a plurality of sprayers necessarily provides a distinct and improved method of such sampling, which include: the ability to position the sampling orifice at any distance from the desired sprayer(s) which allows use of nano- or micro-electrosprayers, the ability to simultaneously utilize any number of different types of sprayers (i.e., electrospray, pneumatic spray, etc.), the ability to independently optimize the conditions for maximum performance and resolution for each sprayer, etc.

It is yet a further object of the invention to provide a multiplexing apparatus in which an endcap electrode and drying gas may be used in conjunction therewith to further enhance the performance of an ESI/HPLC source for a mass spectrometer.

Still further objects of the invention include, but are not limited to: using any number of sprayers; having a sampling device with a different geometry, such as a planar geometry, as opposed to a cylindrically symmetric geometry; comprising a planar array of sprayers with the sampling orifice of the capillary movable in two dimensions to sample the sprayers; using an electronic (or other) mechanism to track the position of the sampling device so that the spectra obtained from the mass analyzer can be correlated with the sprayer being sampled; using a rigid first section of the capillary having a plurality of sampling orifices, one for each sprayer location; etc.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Figure 1:
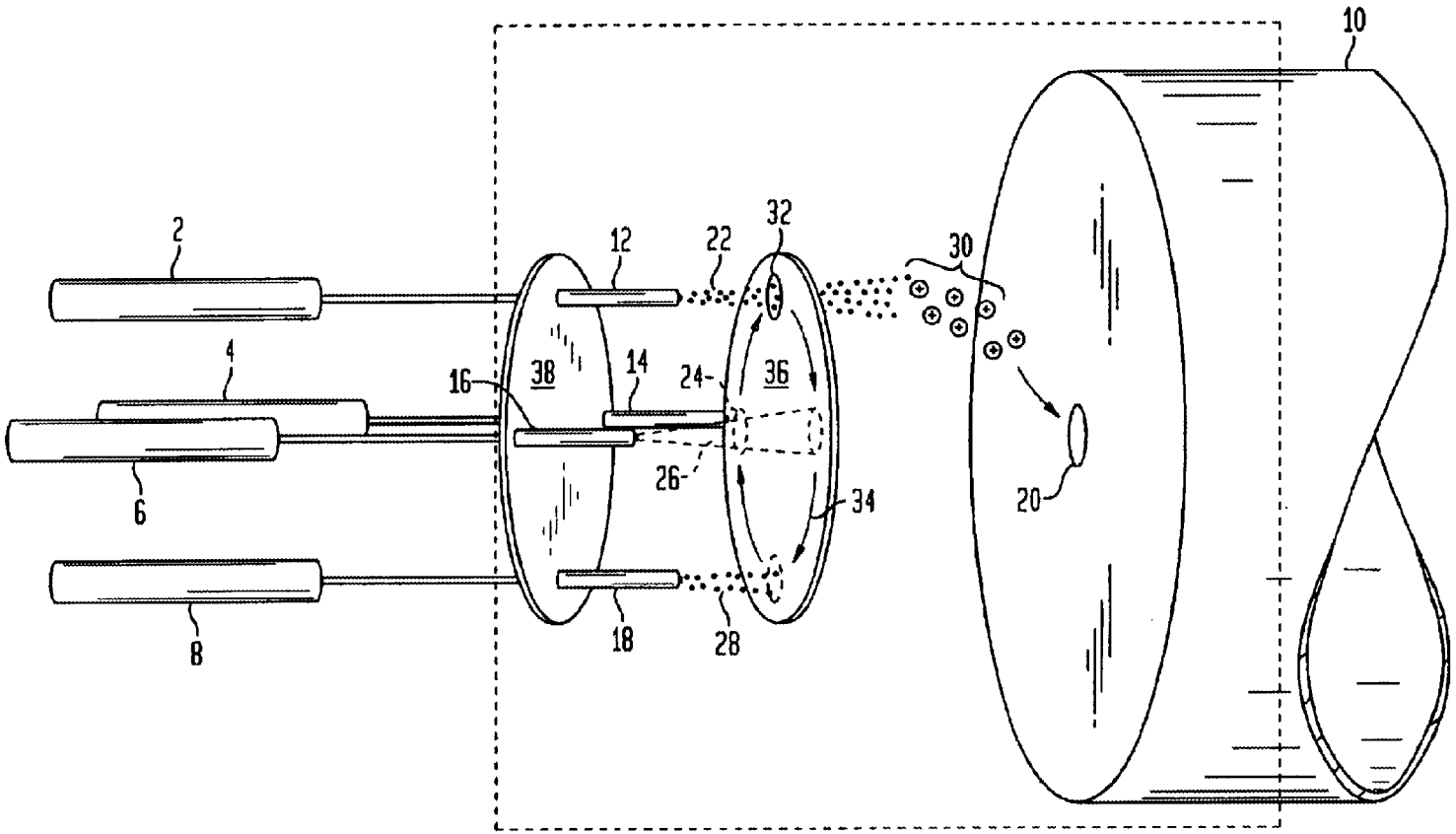
FIG. 1 (PRIOR ART)
FIG. 1 shows a prior art apparatus for multiplexing four spray needles in an electrospray ionization source according to Kassel.
Figure 2:
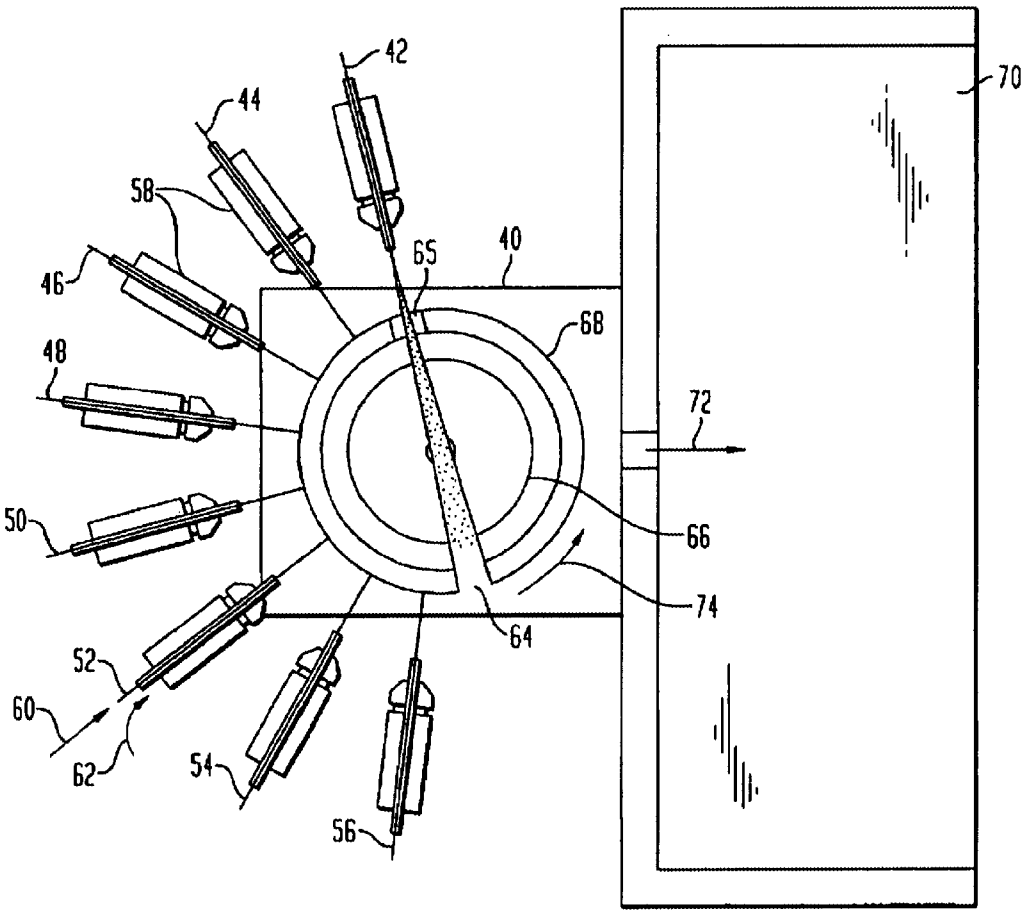
FIG. 2 (PRIOR ART)
FIG. 2 shows another prior art apparatus for multiplexing eight spray needles in an electrospray ionization source according to Bateman.
Figure 3:
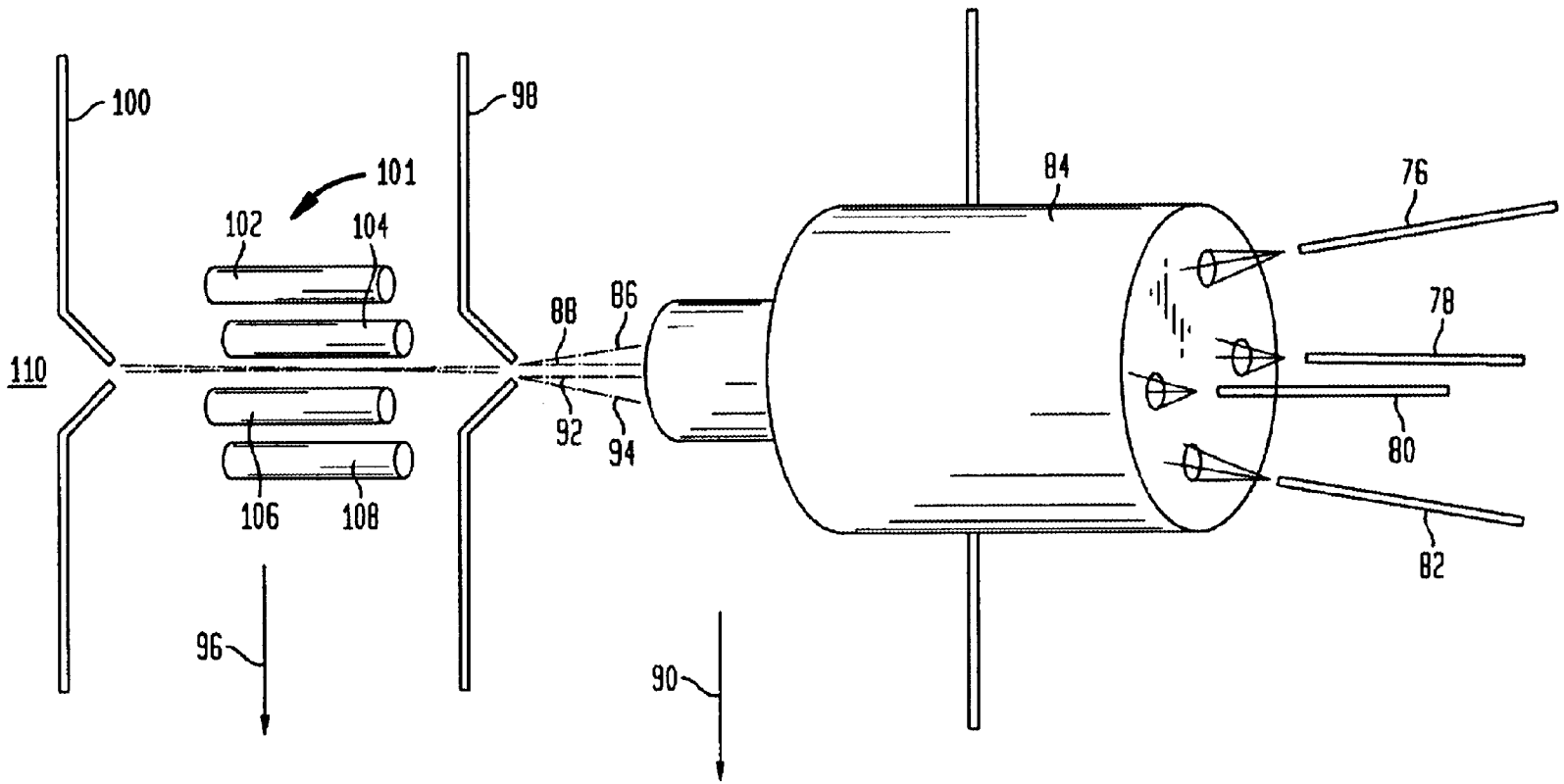
FIG. 3 (PRIOR ART)
FIG. 3 shows yet another prior art multi-ESI-sprayer, multinozzle TOF mass spectrometry apparatus according to Jiang.
Figure 4:
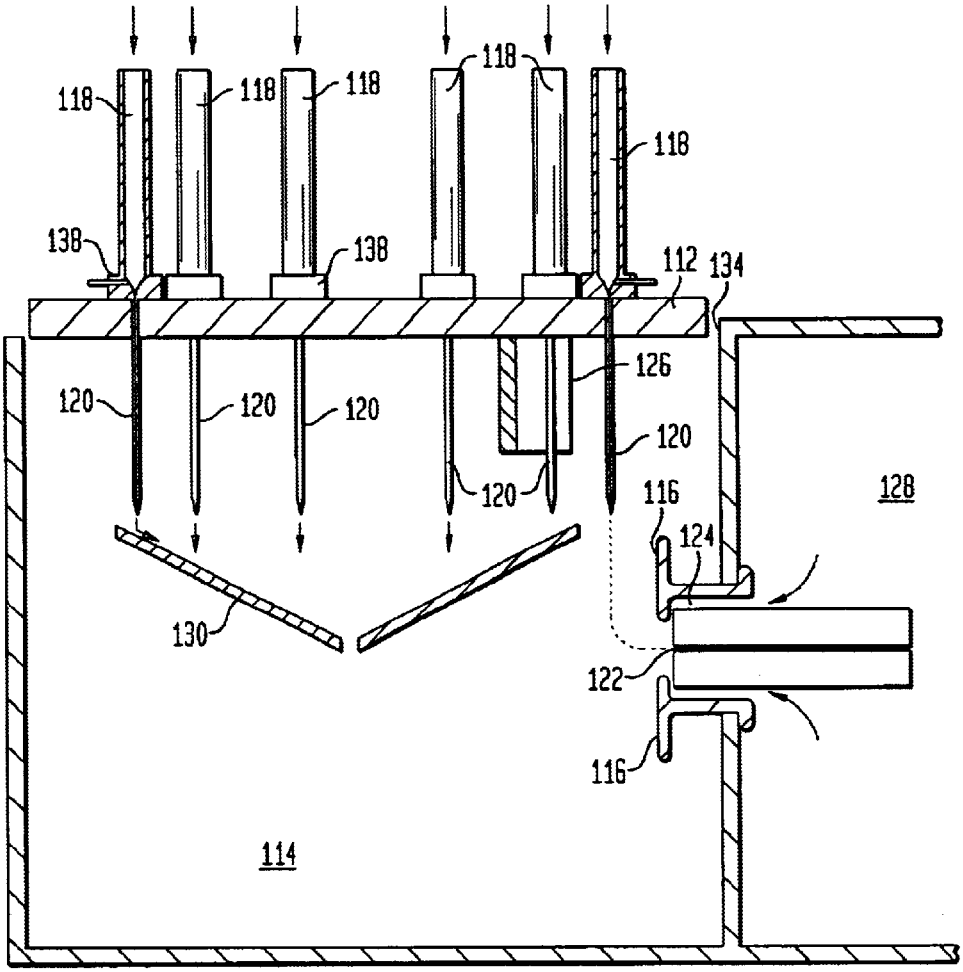
FIG. 4 (PRIOR ART)
FIG. 4 shows yet another prior art apparatus for multiplexing spray needles in an electro spray ionization source according to Hindsgaul.
Figure 5:
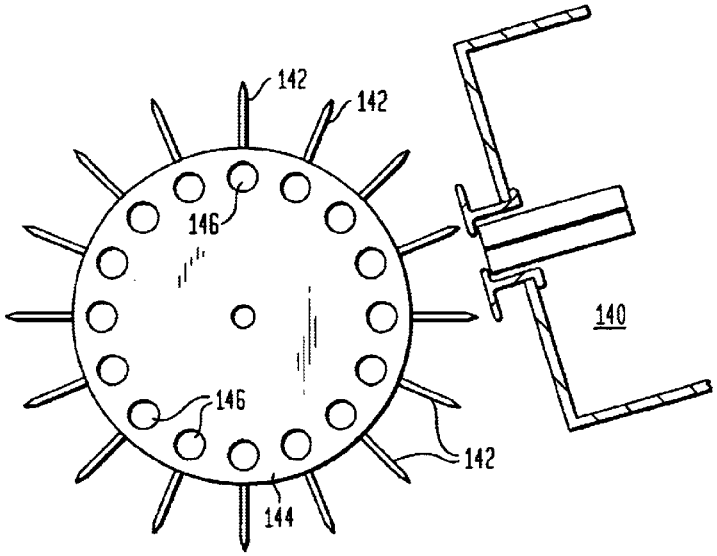
FIG. 5 (PRIOR ART)
FIG. 5 shows yet another prior art apparatus for multiplexing spray needles in an electrospray ionization source according to Hindsgaul.
Figure 6:
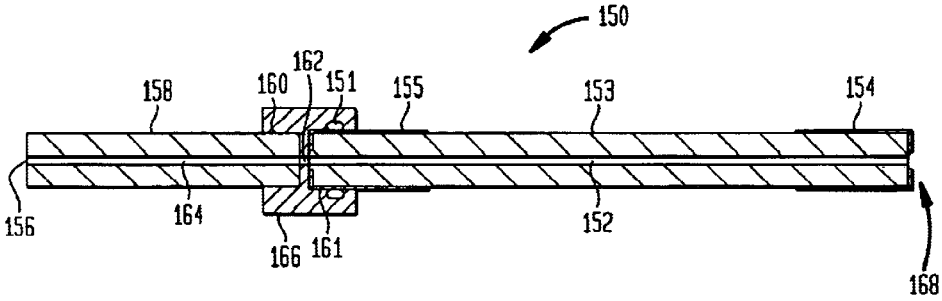
FIG. 6 shows a lateral cross-sectional view of a multiple part capillary for use with the preferred embodiment of the multiplexing apparatus according to the present invention.

With reference first to FIG. 6, shown is multiple part capillary 150 according to the preferred embodiment of the invention disclosed in co-pending application Ser. No. 09/507,423. As depicted in FIG. 6, multiple part capillary 150 comprises: first section 158 having capillary inlet end 156 and first channel 164; union 166 having o-ring 151; and second section 153 having second channel 152, capillary outlet end 168 and metal coatings 155 and 154. According to a described embodiment, first section 158 is connected to second section 153 by union 166, wherein union 166 is substantially cylindrical having two coaxial bores, 160 and 161, and through hole 162 of the same diameter as channels 164 and 152. The inner diameter of bore 160 and the outer diameter of section 158 are chosen to achieve a "press fit" when section 158 is inserted into bore 160. Similarly, the inner diameter of bore 161 is slightly larger than the outer diameter of section 153 (including metal coating 155) so as to produce a "slip fit" between union 166 and section 153. Because the press fit is designed to be tight, union 166 is strongly affixed to section 158 and a gas seal is produced between union 166 and section 158 at the surface of the bore, which is maintained via o-ring 151.

Moreover, metal coating 155 and section 158 are each in direct physical contact with union 166 to establish electrical contact therethrough. Through hole 162 is provided within union 166 to allow for the transmission of ion from entrance end 156 through to exit end 168 of capillary 150. Ideally, union 166 and sections 158 and 153 are formed in such a way as to eliminate any "dead volume" between these components. To accomplish this, the ends of sections 158 and 153 are formed to be flush with the inner surface of union 166. Note that the body of section 153—excluding metal coatings 155 and 154—is described as preferably being composed of glass, although other materials may be used. As a result, metal coating 155—together with union 166 and section 158—may be maintained at a different electrical potential than metal coating 154.

Alternatively, union 166, and sections 28 and 33 may be composed of a variety of conducting or non-conducting materials; the outer diameters of the sections may differ substantially from one another; the inner diameters of the sections may differ substantially from one another; either or both ends or any or all sections may be covered with a metal or other coating; rather than a coating, the ends or capillary sections may be covered with a metal (or some other material) cap; the capillary may be composed of more than two sections always with one fewer union than sections; the union may be any means for removably securing the sections of capillary together and providing an airtight seal between these sections; and section 158 may comprise a flexible, tube-like structure or a rigid, multi-cavity structure (e.g., having a plurality of entrances which lead to a single exit).

Each end of union 166 may comprise a generally cylindrical opening having an internal diameter slightly larger than the external diameter of the end of the capillary section which is to be inserted therein. In such an embodiment, a gas seal is made with each capillary section via an o-ring, similar to o-ring 151. As a further alternative, one might use springs to accomplish electrical contact between union 166 and sections 28 and 33. In this case a conducting spring would be positioned within union 166 adjacent to o-ring 151.

Moreover, in the multiple part capillary for use with the present invention, the length of first section 158 is preferably less than (even substantially less than) the length of second section 153. More specifically, the dimensions of first section 158 and second section 153 are such that within a range of desired pressure differentials across capillary 150, a gas flow rate within a desired range will be achieved. For example, the length of second section 153 and the internal diameter of second channel 152 are such that the gas transport across second section 153 alone (i.e., with first section 158 removed) at the desired pressure differential will not overload the pumps which generate the vacuum in the source chamber of the system. This allows the removal (e.g., for cleaning or replacement) of first section 158 of capillary 150 without shutting down the pumping system of the mass spectrometer.

Furthermore, multiple part capillary 150 for use with the present invention is designed to sample ions from different sources, and preferably comprises a flexible first capillary section 158. This allows the entrance 26 of capillary to be moved to sample ions from different locations. Capillary 150 may directly connect the ion source (not shown) to an analyzer (not shown). Therefore, instead of using the blocking devices as used in the prior art, the present invention uses a multiple-part capillary having a flexible first capillary section 158 which may be moved (e.g., rotated) to multiple ion sources.

Figure 7A:
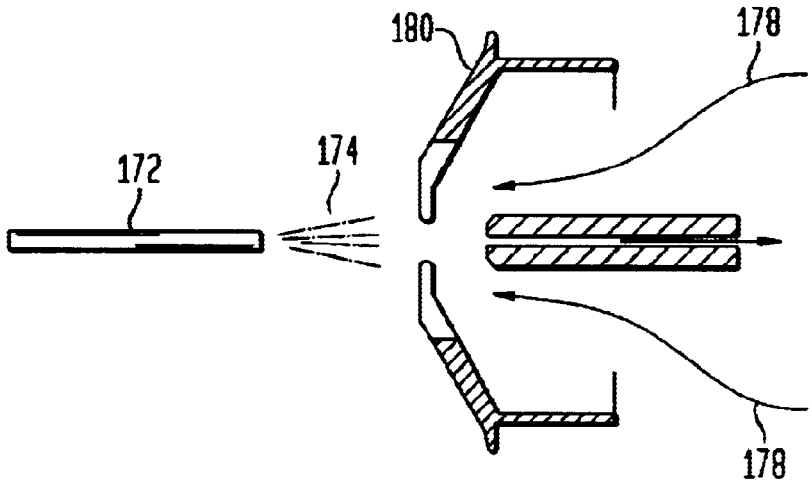
FIG. 7A shows a lateral cross-sectional view of an endcap (positioned between a spray needle and capillary) for use with the preferred embodiment of the multiplexing apparatus according to the present invention.
Figure 7B:
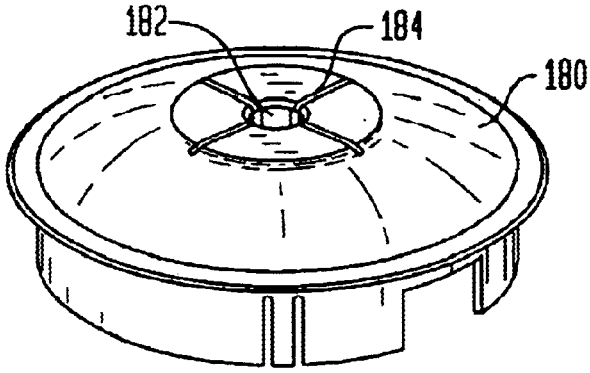
FIG. 7B shows a perspective view of the endcap of FIG. 7A, depicting the endcap's central aperture through which the sample ions flow and the endcap's radial slits through which a drying flows.

Turning next to FIGS. 7A and 7B, depicted is an endcap electrode 180 for use with the present invention. As shown in FIG. 7A, endcap electrode 180 is mounted over a sampling orifice of a capillary tube and directs the flow of heated gas 178 which is used to assist the drying of sprayed droplets 174 from sprayer 172. The electric potential established between endcap electrode 180, the sampling orifice, and sprayer 172 also assists in directing ions into the sampling orifice. As also shown in FIG. 7B, endcap electrode 180 may comprise multiple slits 184 (four are shown, but any number may be used) extending radially from the central aperture 182. These slits 184 may be aligned with each sprayer of the ionization source. Drying gas may then pass through slits 184 from behind endcap electrode 180 towards the respective sprayers and intercept droplets 174 sprayed from sprayer 172. Droplets 174 thus come in contact with a heated drying gas for a longer period of time as they move from the exit of sprayer 172 to the sampling orifice of the capillary tube than would be possible using an endcap electrode without any slits.

Figure 8:
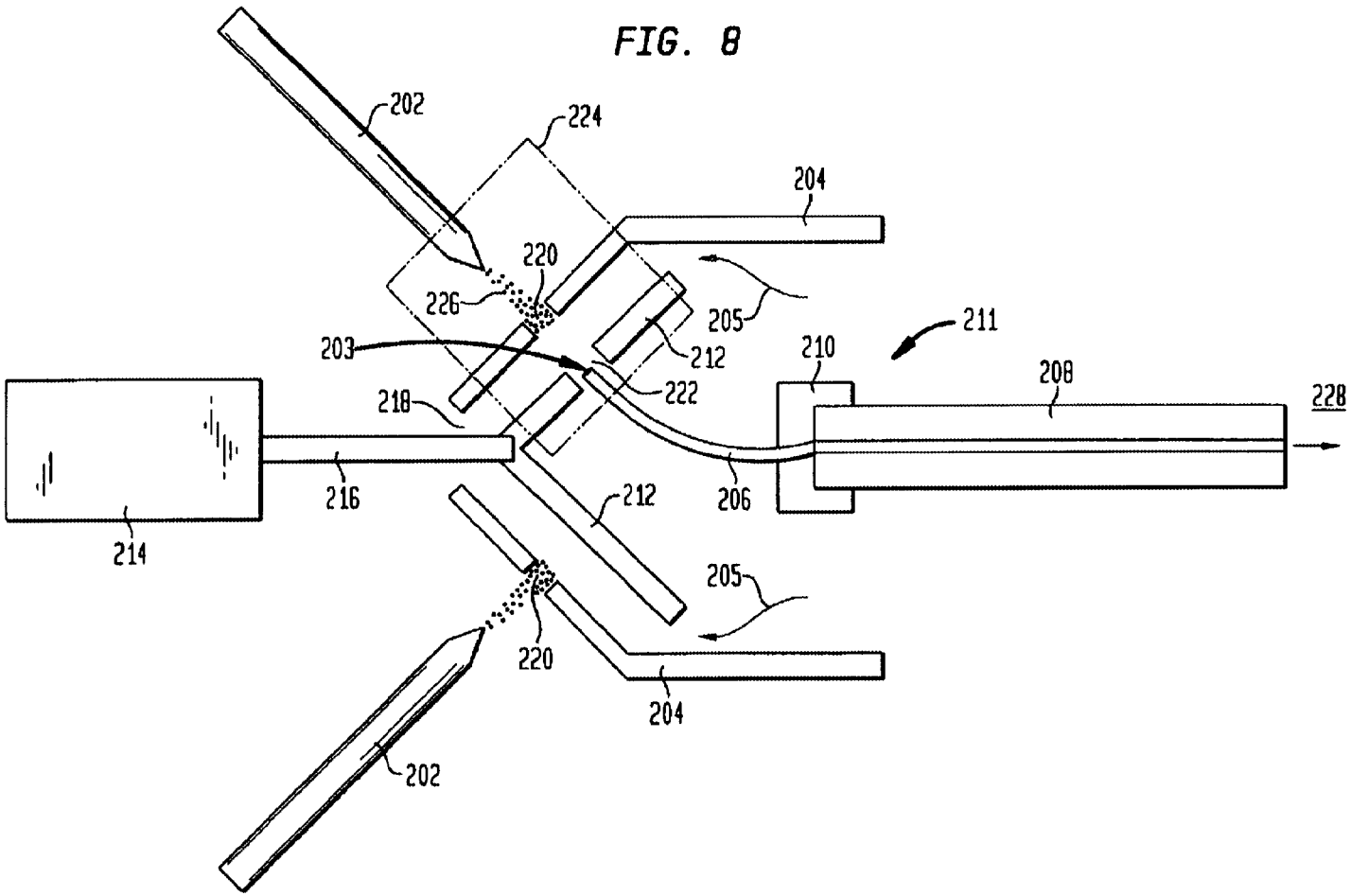
FIG. 8 shows the preferred embodiment of the multiplexing apparatus according to the present invention.

Referring next to FIG. 8, depicted is the preferred embodiment of the means and method for multiplexing sprays in an electrospray ionization source according to the present invention. As shown, a main feature (or aspect) of this embodiment of the present invention includes a multiple part capillary (or multiple section capillary) (an example of which is depicted in FIG. 6), which comprises at least first section 206 and second section 208 connected via union 210. Preferred and alternate embodiments of union 210 are shown and described in greater detail herein above with respect to FIG. 6.

As depicted in FIG. 8, the preferred embodiment of the multiplexing apparatus comprises multiple part capillary 211 having first section 206, second section 208 and union 210, motor 214, connecting rod 216, conical sampling device 212 having aperture 222, and endcap electrode 204. Optionally, a feedback device (not shown) may be used for identifying when the sampling orifice is correctly positioned with each individual sprayer. Such a feedback device may be an array of light emitting diodes (LEDs) and photodiodes (or simple switches, etc.) arranged at each sprayer such that the path of light between an LED and photodiode is blocked (or such that the contact of the simple switch remains open) until the sampling orifice is properly positioned with respect to a sprayer. Of course, other known feedback devices may alternatively be used. Preferably, the multiplexing apparatus according to the invention is used with a plurality of sprayers 202. Although only two are shown in FIG. 8, any number may be used (i.e., three, four, five, etc.). In addition, even though sampling device 212 is shown and described herein as having a conical shape, it is further anticipated that sampling devices having other shapes may be used, such as a pyramid (which may have as many sides as there are sprayers (i.e., three, four, five, etc.).

Next, first section 206 of capillary 211 is preferably composed of flexible material (e.g., polymer) in order for its sampling orifice 203 to be moved from one sprayer 202 to another. To facilitate such movement of sampling orifice 203, the entrance end of first section 206 is loosely mounted in aperture 222 of sampling device 212 such that orifice 203 may rotate freely within aperture 222, while the opposing end of first section 206 is firmly positioned adjacent to capillary second section 208 by union 210. For example, the entrance end of first section 206 may be rotatably fastened to sampling device 212 within aperture 222 via a radial bushing (not shown). Sampling device 212 preferably comprises a single aperture 222 in which the entrance end of capillary first section 206 is loosely attached to allow it to rotate therein. Optionally, more than one aperture 222 may be used in sampling device 212. This single aperture 222 is positioned on sampling device 212 such that when sampling device 212 is rotated to a first position by motor 214, single aperture 222 is aligned with a first sprayer 202 such that ions produced by sprayer 202 may pass through aperture 222 and into sampling orifice 203 of capillary 211. Then, sampling device 212 may be rotated (either smoothly or in a stepped manner) to a second position aligning aperture 222 with a second sprayer 202, wherein ions from this sprayer are introduced into sampling orifice 203 of capillary 211, and so on. This multiplexing apparatus may be used with any number of sprayers, such that sampling orifice 203 of capillary 211 may sequentially and repetitively sample ions produced from a plurality of sprayers 202.

Sampling device 212 is preferably mounted on motor 214 by connecting rod 216 and may be rotated either at constant velocity (i.e., smoothly) or in jumps (or steps) from one sprayer to the next. The velocity of sampling device 212 may be controlled by a computer or other electronic controller (not shown) to allow for the most efficient and accurate rotational speed. Sprayers 202 are mounted symmetrically (i.e., evenly spaced) around the axis of sampling device 212 for optimum performance of the multiplexing apparatus.

Also in the preferred embodiment, endcap electrode 204 is positioned between sprayers 202 and sampling device 212. Preferably, endcap electrode 204 directs the flow of heated drying gas (as indicated by arrows 205) toward sprayed droplets 226 to help facilitate the evaporation of sprayed droplets 226 from sprayer 202 to form sample ions. Drying gas may then pass between endcap electrode 204 and sampling device 212 (arrows 205) towards the respective sprayers and intercept droplets 226 sprayed from sprayers 202. The drying gas flow rate and temperature may be altered for optimum efficiency. Droplets 226 thus come in contact with a heated drying gas for a longer period of time as they move through aperture 220 of endcap electrode 204 from the exit of sprayers 202 to sampling orifice 203 than would be possible in an apparatus without an endcap electrode. Preferably endcap electrode 204 is fixed with respect to sprayers 202 and capillary 211, and is not rotated by motor 214 along with sampling device 212. However, in an alternate embodiment, endcap electrode 204 may comprise a single aperture 220 and be affixed to connecting rod 216 in a similar manner to sampling device 212 such that single aperture 220 and sampling orifice 203 move together from sprayer to sprayer.

Also, an electric potential is established between endcap electrode 204, sampling orifice 203, and sprayers 202 to direct the ions into sampling orifice 203. As depicted in FIG. 8, endcap electrode 204 preferably comprises multiple apertures 220 (two are shown, but any number may be used—one for each sprayer used). Each such aperture 220 is positioned in alignment with each sprayer 202 of the ionization source.

As indicated above, use of flexible first section 206 of capillary 211 allows for the optimization of conditions for each sprayer 202 used in the multiplexing apparatus of the invention. For example, the conditions established for region 224, from sprayer 202 through aperture 220 to sampling orifice 203, are identical for each sprayer 202 used with the apparatus. In other words, when motor 214 rotates sampling device 212 via connecting rod 216 from one sprayer 202 to another, each and every condition (e.g., distance from sprayer 202 to aperture 220, distance from aperture 220 to sampling orifice 203, electric field between sprayer 202, aperture 220 and sampling orifice 203, etc.) remains the same. Of course, if the experiment or test warrants, a variation in conditions could be made.

As stated herein above, the multiplexing apparatus described herein provides for an improved method of multiplexing a plurality of samples. That is, the process of multiplexing a plurality of samples using the apparatus of the present invention includes first, forming a sample spray from the plurality of sprayers. Second, the droplets from the sample spray are desolvated in an electric field wherein sample ions are formed. Then, third, the device selects the specific sprayer from which to accept the sample spray. Fourth, and finally, the sample ions are transported into a mass spectrometer. This sequence of spraying, desolvating, selecting, and then transporting the sample ions provides significant improvements and advantages over the prior art multiplexing devices.

More particularly, during operation of the preferred embodiment of the multiplexing apparatus of the invention, as described above, sample liquid, in the form of sample droplets 226 are sprayed from sprayers 202 ions in the direction of aperture 220 of endcap electrode 204 and sampling orifice 203 of sampling device 212. Sample droplets 226 are then desolvated in this region between sprayers 202 and sampling orifice 203, thereby forming the sample ions to be analyzed. That is, the spray droplets from sprayer 202 evaporate, optionally with the assistance of a heated drying gas, in this region to form ions. At the same time, an electric field is created therein through the application of a potential difference between sprayers 202, endcap electrode 204 and sampling orifice 203. This electric field directs the ions sprayed from sprayers 202 through aperture 220 of endcap electrode 204 and into sampling orifice 203 of multiple part capillary 211. For a given multiplexing apparatus, one or more sprayers 202 may have the same or different electric fields generated in the region between it, endcap electrode 204 and sampling orifice 203, depending on a variety of factors (i.e., the type of sample being analyzed, the solution conditions, the type of solvent, etc.).

Through rotation of sampling device 212 by motor 214, sampling orifice 203 of multiple part capillary 211 may be rotated into position for selecting sample ions from different sprayers 202. As mentioned above, this rotation may be stepped or continuous (i.e., at constant velocity). In other words, sampling orifice 203 need not be rotated with a constant angular velocity, rather it may be rotated in "steps", directly from one sprayer to the next such that more time is spent sampling ions from sprayers 202 than is spent moving sampling orifice from one sprayer to another.

It is preferred that the multiplexing apparatus is configured such that the relationship of sprayers 202 to sampling orifice 203 is optimized. That is, the conditions necessary for obtaining optimum mass analysis results in the form of a mass spectrum are met for each sprayer 202. For example, the positioning of sampling orifice 203 is exactly the same with respect to each and every sprayer used due to the symmetrical arrangement of the sprayers and sampling device. Thus, ideal conditions may be established for each sprayer without any negative effects due to the movement of sampling orifice 203 from sprayer to sprayer.

Figure 9:
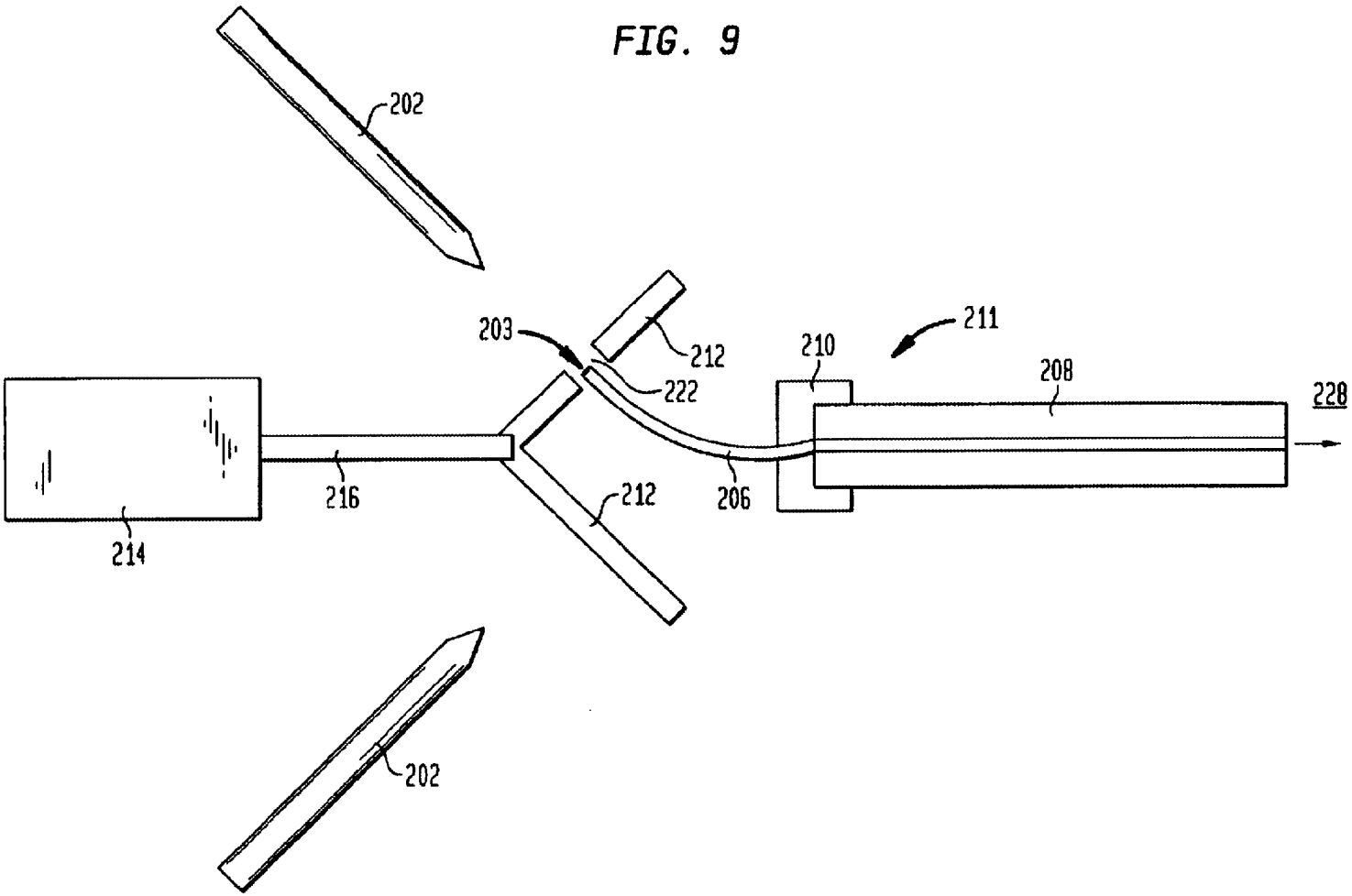
FIG. 9 shows the multiplexing apparatus depicted in FIG. 8, without an endcap positioned between the sprayers and the capillary entrance.

Referring next to FIG. 9, depicted is an alternate embodiment of the means and method for multiplexing sprays in an electrospray ionization source according to the present invention. The alternate embodiment shown is different from the preferred embodiment in that it does not include an endcap electrode. As depicted, a main feature (or aspect) of this embodiment of the invention, like the preferred embodiment, includes a multiple part capillary (or multiple section capillary) (an example is depicted in FIG. 6), which comprises at least first section 206 and second section 208 connected via union 210. Union 210 is shown and described in greater detail herein above with respect to FIG. 6.

As described above regarding the preferred embodiment of the invention shown in FIG. 8, the multiplexing apparatus preferably comprises multiple part capillary 211 having first section 206, second section 208 and union 210, motor 214, connecting rod 216, and conical sampling device 212 having aperture 222. As also described above, the multiplexing apparatus is used with a plurality of sprayers 202—although only two are shown, any number may be used. In addition, even though sampling device 212 is shown and described herein as having a conical shape, it is further anticipated that sampling devices having other shapes may be used.

Moreover, as with the preferred embodiment described above, first section 206 of capillary 211 is preferably composed of flexible material (e.g., polymer) in order for its sampling orifice 203 to be moved from one sprayer 202 to another. To facilitate such movement of sampling orifice 203, the entrance end of first section 206 is loosely mounted in aperture 222 of cone 212 such that orifice 203 may rotate freely within aperture 222. For example, the entrance end of first section 206 may be rotatably fastened to cone 212 within aperture 222 via a radial bushing (not shown).

As previously described, sampling device 212 comprises a single aperture 222 in which the entrance end of capillary first section 206 is loosely attached to allow it to rotate therein. The opposing end of first section 206 is firmly positioned adjacent to capillary second section 208 by union 210. This single aperture 222 is positioned on sampling device 212 such that when sampling device 212 is rotated to a first position by motor 214, single aperture 222 is aligned with a first sprayer 202 such that ions produced by sprayer 202 may pass through aperture 222 and into sampling orifice 203 of capillary 211. Then, sampling device 212 may be rotated (either smoothly or in a stepped manner) to a second position aligning aperture 222 with a second sprayer 202, wherein ions from this sprayer are introduced into sampling orifice 203 of capillary 211, and so on. This multiplexing apparatus may be used with any number of sprayers, such that sampling orifice 203 of capillary 211 may sequentially and repetitively sample ions produced from a plurality of sprayers 202.

Sampling device 212 is preferably mounted on motor 214 by connecting rod 216 and may be rotated either at constant velocity (i.e., smoothly) or in jumps (or steps) from one sprayer to the next. The velocity of sampling device 212 may be controlled by a computer or other electronic controller (not shown) to allow for the most efficient and accurate rotational speed. Sprayers 202 are mounted symmetrically (i.e., evenly spaced) around the axis of sampling device 212 for optimum performance of the multiplexing apparatus.

During operation of the multiplexing apparatus described above, ions are typically generated in the region between sprayers 202 and sampling orifice 203. That is, the spray droplets from sprayer 202 evaporate in this region to form ions. At the same time, an electric field is created therein through the application of a potential difference between sprayers 202 and sampling orifice 203. This electric field directs the ions sprayed from sprayers 202 to sampling orifice 203 of multiple part capillary 211. For a given multiplexing apparatus, one or more sprayers 202 may have the same or different electric fields generated in the region between it and sampling orifice 203, depending on a variety of factors (i.e., the type of sample being analyzed, the solution conditions, the type of solvent, etc.).

Through rotation of sampling device 212 by motor 214, sampling orifice 203 of multiple part capillary 211 may be rotated to positions for sampling ions from sprayers 202. As mentioned above, this rotation may be stepped or continuous. It is preferred that the multiplexing apparatus is configured such that the relationship of sprayers 202 to sampling orifice 203 is optimized. That is, the conditions necessary for obtaining optimum mass analysis results in the form of a mass spectrum are met for each sprayer 202. For example, the positioning of sampling orifice 203 is exactly the same with respect to each and every sprayer used due to the symmetrical arrangement of the sprayers and sampling device. Thus, ideal conditions may be established for each sprayer without any negative effects due to the movement of sampling orifice 203 from sprayer to sprayer.

Figure 10:
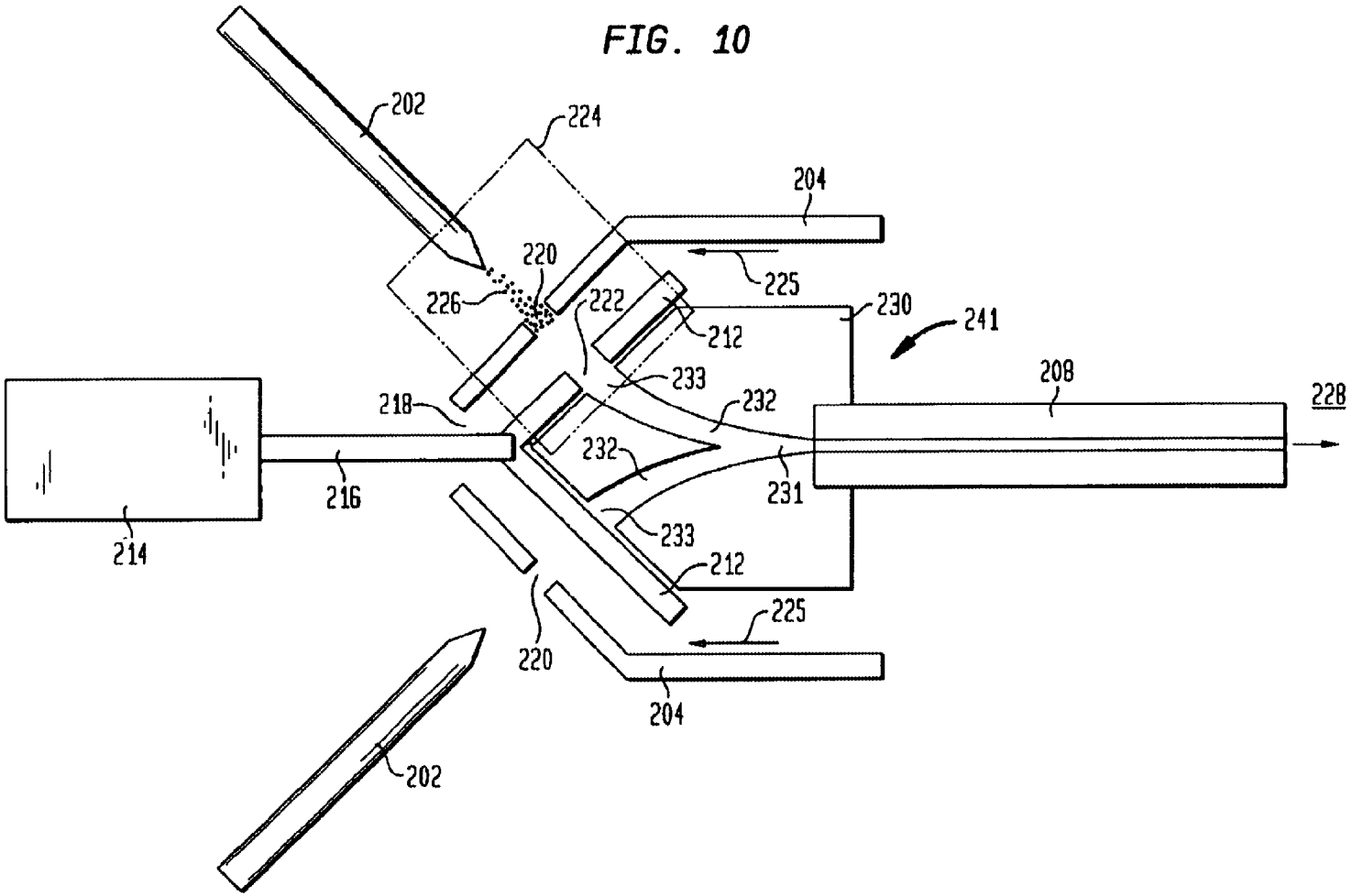
FIG. 10 shows an alternate embodiment of the multiplexing apparatus according to the present invention.
Figure 11:
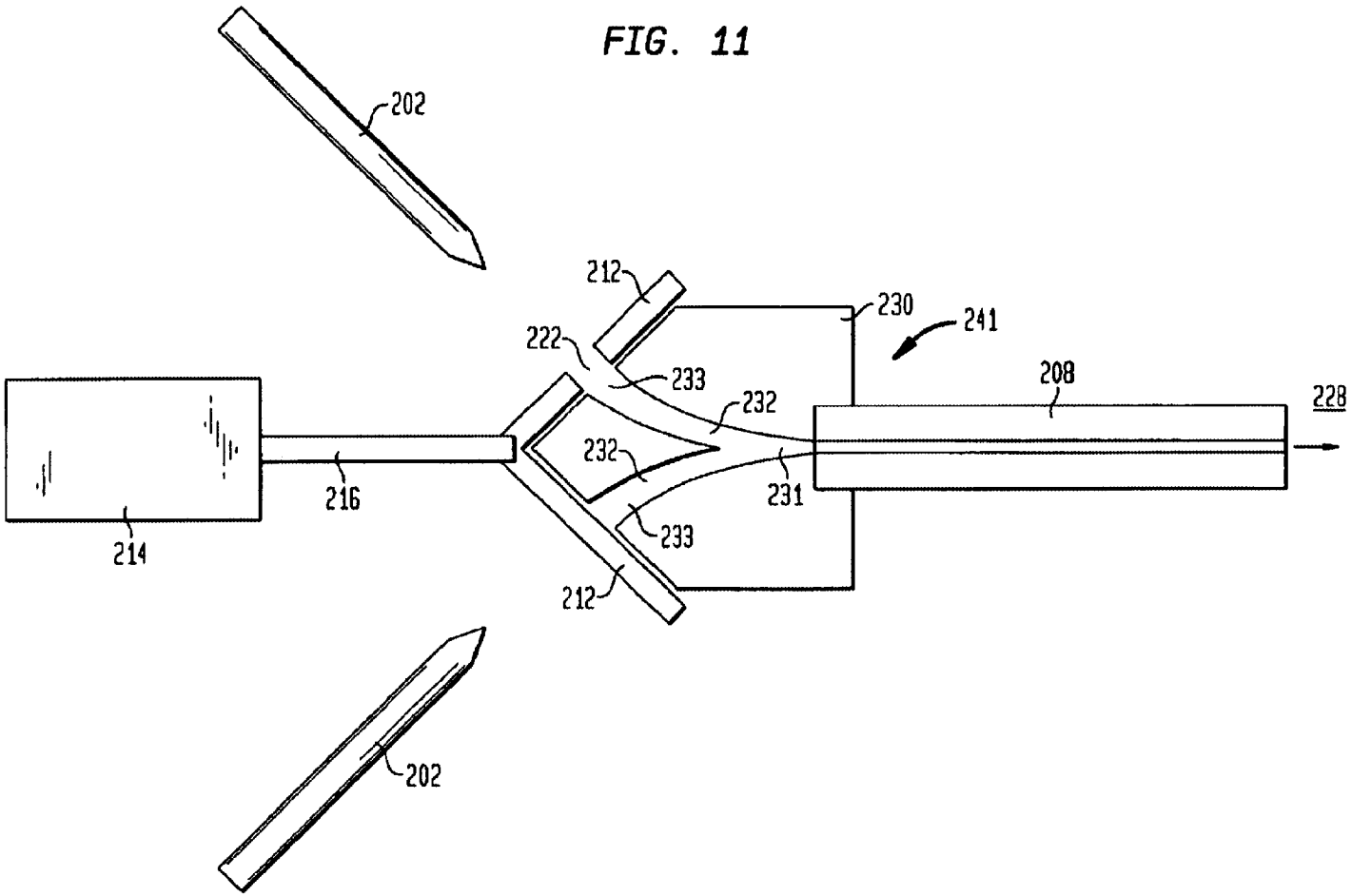
FIG. 11 shows the multiplexing apparatus depicted in FIG. 10, without an endcap positioned between the sprayers and the capillary entrance.
Figure 12:
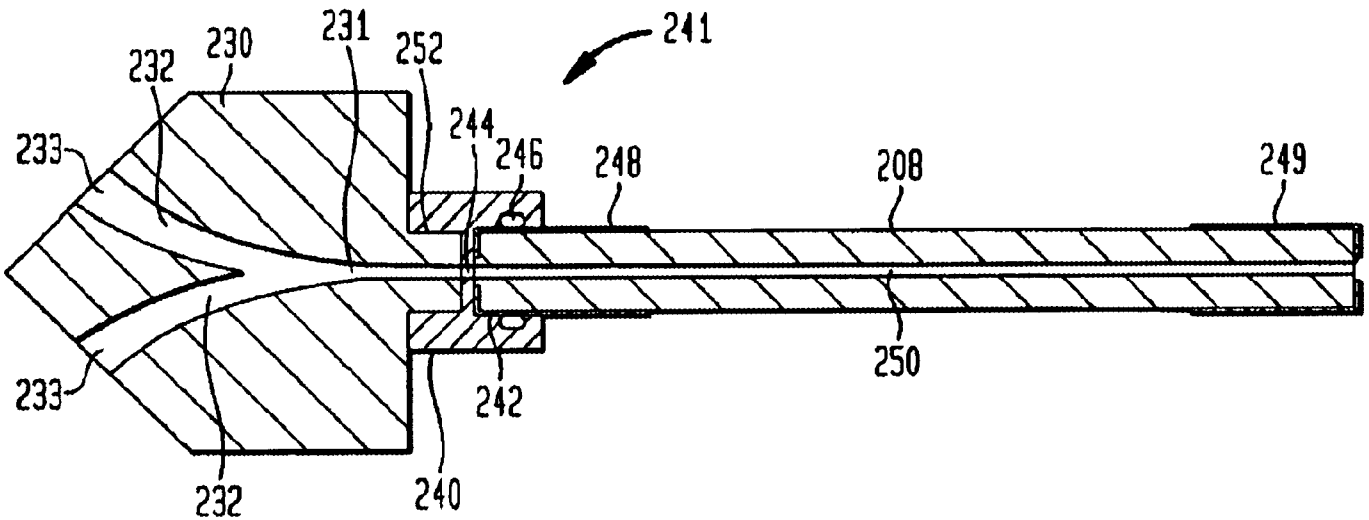
FIG. 12 shows a lateral cross-sectional view of a multiple part capillary for use with the multiplexing apparatus of FIGS. 10 and 11.

Yet further alternate embodiments of the multiplexing apparatus of the present invention are depicted in FIGS. 10–12. In particular, FIGS. 10–11 depict the multiplexing apparatus shown in FIGS. 8–9, respectively, but including a different embodiment of first section 230 of capillary 241. As shown in both FIGS. 10–11, first section 230 comprises a shape which substantially conforms to the inner side of sampling device 212 such that sampling device 212 may be rotated around it. Also, first section 230 may comprise multiple sampling orifices 233 steming from multiple channels 232 which branching off from a single exit channel 231 which leads to second section 208. Ions introduced into sampling orifice 233 from sprayer 202 then travel through channels 232 and 231 into second section 208 and on to mass analyzer region 228, which may comprise any conceivable known mass analyzer, including but not limited to time-of-flight (TOF), quadrupole (Q), Fourier transform ion cyclotron resonance (FTICR), ion trap, magnetic (B), electrostatic (E), ion cyclotron resonance (ICR), quadrupole ion trap analyzers, etc. In this embodiment, first section 230 need not rotate along with sampling device 212, as there may be as many sampling orifices 233 as there are sprayers 202. Of course, first section 230 may alternatively comprise a single channel therethrough and only have a single sampling orifice 233. in this embodiment, first section 230 would need to be affixed to sampling device 212 such that sampling orifice 233 moved along with aperture 222 in sampling device 212 from sprayer to sprayer.

As with multiple part capillary 211 shown in FIGS. 8–9, first section 230 of capillary 241 must be securely positioned adjacent to second section 208 to provide a continuous channel from sampling orifice 233 to mass analyzer region 228. To do so, it is preferred that a connector such as union 240 be used, as shown in FIG. 12. Union 240 is identical to union 166 shown in FIG. 6 herein. As described therefor, first section 230 is connected to second section 208 by union 240, wherein union 240 is substantially cylindrical having two coaxial bores, 252 and 242, and through hole 244 of the same diameter as channels 231 and 250. The inner diameter of bore 252 and the outer diameter of first section 230 are chosen in order to achieve a "press fit" when first section 230 is inserted into bore 252. Similarly, the inner diameter of bore 242 is slightly larger than the outer diameter of second section 208 (including metal coating 248) so as to produce a "slip fit" between union 240 and second section 208. Because the press fit is designed to be tight, union 240 is strongly affixed to first section 230 and a gas seal is produced between union 240 and first section 230 at the surface of bore 252. Similarly, union 240 is strongly affixed to second section 208 and a gas seal is produced between union 240 and second section 208 at the surface of bore 242, which is maintained via o-ring 246.

Moreover, metal coating 248 and first section 230 are each in direct physical contact with union 240 to establish electrical contact therethrough. Through hole 162 is provided within union 240 to allow for the transmission of ion from sampling orifices 233 through to the exit end of second section 208. Ideally, union 240 and first and second sections 230 and 208 are formed in such a way as to eliminate any "dead volume" between these components. To accomplish this, the ends of sections 230 and 208 are formed to be flush with the inner surface of union 240. Note that the body of second section 208—excluding metal coatings 248 and 249—is preferably composed of glass, although other materials may be used. As a result, metal coating 248—together with union 240 and first section 230—may be maintained at a different electrical potential than metal coating 249.

Additionally, both ends of union 240 may comprise generally cylindrical openings having internal diameters slightly larger than the external diameters of the ends of sections 230 and 208. In such an embodiment, a gas seal is provided between each of first section 230 and union 240 as well as between second section 208 and union 240 via 246. Optionally, springs may be used to accomplish electrical contact between union 240 and sections 230 and 208. In this embodiment, a conducting spring would be positioned within union 240 adjacent to o-ring 246.

Figure 13:
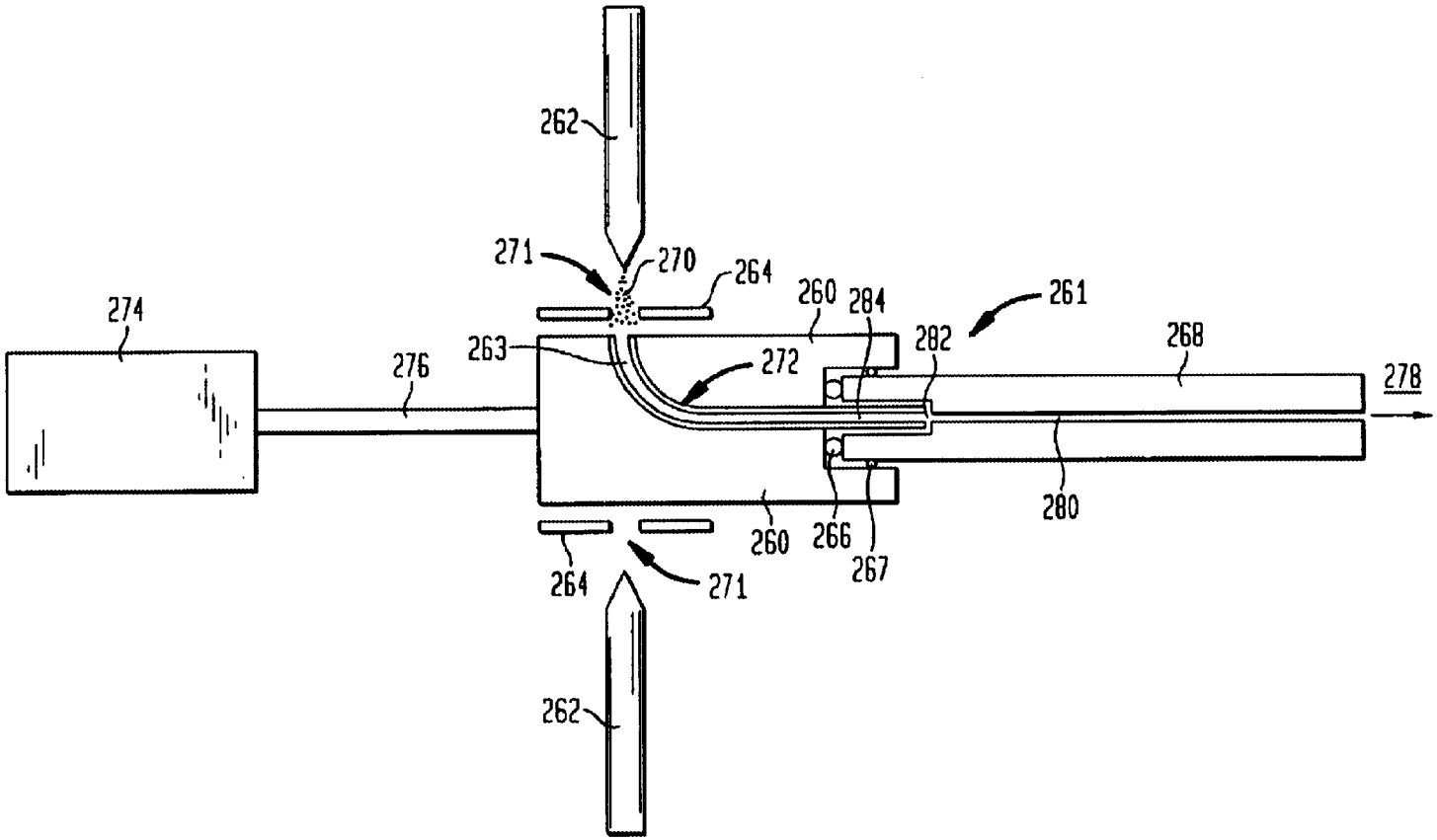
FIG. 13 depicts an alternate embodiment of the multiplexing apparatus according to the present invention.

Still another alternate embodiment of the multiplexing apparatus of the present invention is depicted in FIG. 13. In particular, FIG. 13 depicts a multiplexing apparatus including yet a different embodiment for first section 260 of capillary 261. As shown in FIG. 13, first section 260 comprises a generally cylindrical shape. Although it is generally preferred that the cross-section of first section 260 be circular, it may nonetheless take any of a number of shapes and sizes, such as triangular, square, hexagonal, etc., while remaining within the scope and spirit of the invention. Also, in this alternate embodiment, unlike the alternate embodiment shown in FIGS. 10–12, first section 260 preferably comprises a single sampling orifice 263 stemming from channel 272 which leads to second section 208 at exit end 284. Ions introduced into sampling orifice 263 from sprayer 262 then travel through channel 272 into second section 208 and on to the next region 278 of a mass analyzer.

Further, first section 260 is connected to motor 274 via connecting arm 276, which rotates first section 260 (and sampling orifice 263) by motor 274 such that sampling orifice 263 is moved from one sprayer 262 to another. Although FIG. 13 shows only two sprayers 262, any number of sprayers 262 may be used with this embodiment.

Also, as with multiple part capillary 211 shown in FIGS. 8–9, and capillary 241 shown in FIGS. 10–12, first section 260 must be securely positioned adjacent to second section 268 to provide a "continuous" channel from sampling orifice 263 to next mass analyzer region 278, while allowing first section 260 to rotate with respect to second section 268, as further shown in FIG. 13. For this, it is preferred that sealing rings 266 and/or 267 be used, which may be positioned between first section 260 and second section 268, as shown. Alternatively, first section 260 and second section 268 may be fit together such that no sealing rings are used. That is, first section 260 and second section 268 may be very closely fit such that minimal gas leak occurs while allowing the sections to rotate with respect to each other. Further, lubricating material may optionally be used with sealing rings 266 and/or 267 to ensure that first section 260 may rotate smoothly with respect to second section 268. Optionally, an external connector, similar to union 240 depicted in FIGS. 12, may be used to movably secure first section 260 to a second section 268.

Also, as shown in FIG. 13, it is preferred that first section 260 be designed and positioned such that exit end 284 of channel 272 is within a portion of the entrance end of second section 268 while keeping exit end 284 in alignment with the entrance to channel 280 of second section 268. Further, exit end 284 is preferably positioned such that minimal spacing 282 is provide between exit end 284 and the entrance to channel 280 of second section 268, although it may be positioned at any desired distance. In other words, it is generally preferred that first and second sections 260 and 268, and there interconnection, are formed in such a way as to eliminate any "dead volume" therebetween. Optionally, exit end 284 of section 260 and the entrance end of section 268 may be formed to be flush with each other. Also, as shown in FIG. 13, sprayers 262 are positioned parallel (or coaxial) with the axis of sampling orifice 263. However, it is appreciated herein that sprayers 262 may be positioned at any angle with respect to the axis of sampling orifice 263 (e.g., from 0° to 90°). Also, each sprayer 262 may be positioned at a different angle than each other sprayer 262.

Furthermore, it is preferred that the body of second section 268—excluding any metal coatings thereon—is preferably composed of glass, although other non-conducting as well as conducting materials may be used. That is, for example, it may be desirable to maintain section 260 at a different electrical potential than the exit end of capillary section 268 (which may have a metal/conductive endcap thereon). In addition, as shown, a gas seal is provided between first section 260 and second section 268 via sealing rings (or o-rings) 266 and/or 267. Alternatively, as stated above, first section 260 and second section 268 may be fit together such that no sealing rings are used. Optionally, springs (not shown) may be used to accomplish electrical contact between section 260 and any metal or conductive endcap positioned on the entrance end of capillary section 268. For example, in this embodiment, a conducting spring may be positioned adjacent to o-rings 266 and/or 267.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A multiple section capillary for multiplexing a plurality of samples from a plurality of ion production devices, said capillary comprising:

a first section having a first channel and a sampling orifice, said first section to receive ions from a source; and a second section having a second channel and an outlet;

wherein said first section is coaxially and electrically connected to said second section, wherein said first section is composed of a flexible material such that said sampling orifice of said first section can move freely between said ion sources; and wherein said sampling orifice is moved to an optimum position for a particular sampling of ions from a particular ion production devices.

2. A capillary according to claim 1, wherein said second section is greater in length than said first section.

3. A capillary according to claim 1, wherein each of said plurality of ion production devices are selected from the group consisting of: electrosprayers, nanosprayers, microsprayers and pneumatic sprayers.

4. A capillary according to claim 1, wherein said first section is connected to said second section via a union.

5. A capillary according to claim 1, wherein said capillary is positioned to receive ions from an ion source region and transport said ions to a mass analyzer region.

6. An apparatus for multiplexing a plurality of samples from a plurality of sprayers, said apparatus comprising:

a multiple section capillary having first and second sections;

a motor;

a connecting rod;

a sampling device having at least one aperture; and an endcap electrode;

wherein said first section is constructed from flexible material, wherein said first section has at least one sampling orifice, wherein an exit end of said first section is coaxially and electrically connected to said second section, wherein said sampling device is mounted on said motor by said connecting rod, wherein said endcap electrode directs heated drying gas toward said samples, and wherein said motor rotates said sampling device such that ions from each of said plurality of sprayers maybe introduced into said sampling orifice when said aperture and said sampling orifice are aligned with said sprayers.

7. An apparatus according to claim 6, wherein said capillary leads directly into a first vacuum region.

8. An apparatus according to claim 6, wherein said sampling device is conical.

9. An apparatus according to claim 6, wherein said apparatus is used to sequentially sample said ions from said plurality of sprayers.

10. An apparatus according to claim 6, wherein an electric potential is established between said endcap electrode, said aperture and each of said plurality of sprayers to facilitate transportation of ions through said aperture of said sampling device.

11. An apparatus according to claim 6, wherein said endcap electrode has a plurality of apertures and wherein the number of apertures in said endcap electrode corresponds to the number of said sprayers being utilized.

12. An apparatus according to claim 6, wherein said rotation of said sampling device is continuous.

13. An apparatus according to claim 6, wherein said rotation of said sampling device is periodic such that said aperture of said sampling device is aligned with said sprayers for a greater period of time than for said rotation of said sampling device.

14. An apparatus according to claim 6, wherein movement of said sampling device is controlled by an electronic controller.

15. An apparatus according to claim 6, wherein said plurality of sprayers are mounted symmetrically around an axis of said sampling device such that the positioning of said sampling device is substantially the same with respect to each of said plurality of sprayers.

16. An apparatus according to claim 6, wherein said entrance end of said first section substantially conforms to said aperture of said sampling device such that said entrance end of said first section is movably mounted in said aperture of said sampling device.

17. An apparatus according to claim 6, wherein said apparatus is used to introduce ions into one or more mass analyzers for subsequent analysis.

18. An apparatus according to claim 17, wherein said mass analyzers are selected from the group consisting essentially of a time-of-flight (TOF) mass analyzer, quadrupole (Q) mass analyzer, Fourier transform ion cyclotron resonance (FTICR) mass analyzer, ion trap mass analyzer, magnetic (B) mass analyzer, electrostatic (E) mass analyzer, ion cyclotron resonance (ICR) mass analyzer, and quadrupole ion trap mass analyzer.

19. An apparatus for multiplexing a plurality of samples from a plurality of sprayers, said apparatus comprising:

a multiple section capillary having first and second sections;

a motor;

a connecting rod;

a sampling device having at least one aperture; and an endcap electrode;

wherein said first section has at least one sampling orifice, wherein an exit end of said first section is coaxially and electrically connected to said second section, wherein said sampling device is mounted on said motor by said connecting rod, wherein said endcap electrode directs heated drying gas toward said samples, wherein said motor rotates said sampling device such that ions from each of said plurality of sprayers maybe introduced into said sampling orifice when said aperture and said sampling orifice are aligned with said sprayers, and wherein said apparatus further comprises a feedback device.

20. An apparatus according to claim 19, wherein said feedback device comprises at least one LED and at least one photodiode.

21. An apparatus according to claim 20, wherein said LEDs and said photodiodes are positioned to detect alignment of said sampling orifice with said sprayers.

22. An apparatus for multiplexing a plurality of samples from a plurality of sprayers, said apparatus comprising:

a multiple section capillary having first and second sections;

a motor;

a connecting rod; and a sampling device having at least one aperture;

wherein said first section is constructed from flexible material, wherein said first section has at least one sampling orifice, wherein an exit end of said first section is coaxially and electrically connected to said second section, wherein said sampling device is mounted on said motor by said connecting rod, and wherein said motor rotates said sampling device such that ions from each of said plurality of sprayers may be introduced into said sampling orifice when said aperture and said sampling orifice are aligned with said sprayers.

23. An apparatus according to claim 22, wherein said capillary leads directly into a first vacuum region.

24. An apparatus according to claim 22, wherein said sampling device is conical.

25. An apparatus according to claim 22, wherein said apparatus is used to sequentially sample said ions from said plurality of sprayers.

26. An apparatus according to claim 22, wherein said sampling device has a plurality of apertures.

27. An apparatus according to claim 22, wherein said rotation of said sampling device is continuous.

28. An apparatus according to claim 22, wherein said rotation of said sampling device is periodic such that more time is spent sampling said ions than is spent rotating said sampling device.

29. An apparatus according to claim 22, wherein movement of said sampling device is controlled by an electronic controller.

30. An apparatus according to claim 22, wherein said plurality of sprayers are mounted symmetrically around an axis of said sampling device such that the positioning of said sampling device is substantially the same with respect to each of said plurality of sprayers.

31. An apparatus according to claim 22, wherein said first section of said multiple capillary device substantially conforms to said sampling device such that said sampling device may rotate around said first section.

32. An apparatus for multiplexing a plurality of samples from a plurality of sprayers, said apparatus comprising:

a multiple section capillary having first and second sections;

a motor;

a connecting rod; and a sampling device having at least one aperture;

wherein said first section has at least one sampling orifice, wherein an exit end of said first section is coaxially and electrically connected to said second section, wherein said sampling device is mounted on said motor by said connecting rod, wherein said motor rotates said sampling device such that ions from each of said plurality of sprayers maybe introduced into said sampling orifice when said aperture and said sampling orifice are aligned with said sprayers, and wherein said apparatus further comprises a feedback device.

33. An apparatus according to claim 32, wherein said feedback device comprises at least one LED and at least one photodiode.

34. An apparatus according to claim 33, wherein said LEDs and said photodiodes are positioned to detect alignment of said sampling orifice with said sprayers.

35. An apparatus according to claim 22, wherein said apparatus is used to introduce ions into one or more mass analyzers for subsequent analysis.

36. An apparatus according to claim 35, wherein said mass analyzers are selected from the group consisting essentially of a time-of-flight (TOF) mass analyzer, quadrupole (Q) mass analyzer, Fourier transform ion cyclotron resonance (FTICR) mass analyzer, ion trap mass analyzer, magnetic (B) mass analyzer, electrostatic (E) mass analyzer, ion cyclotron resonance (ICR) mass analyzer, and quadrupole ion trap mass analyzer.

37. An apparatus for multiplexing a plurality of samples from a plurality of sprayers, said apparatus comprising:

a multiple section capillary having first and second sections, said first section constructed from a flexible material;

a feedback device for detecting alignment of said sampling orifice with said sprayers; and a sampling device having at least one aperture;

wherein said first section has at least one sampling orifice, wherein said first section is coaxially and electrically connected to said second section, wherein said sampling device receives ions from each of said plurality of sprayers, and wherein said aperture is in line with said sampling orifice at each of said plurality of sprayers.

38. An apparatus according to claim 37, wherein said first section comprises a plurality of sampling orifices, wherein each of said sampling orifices receives said ions such that said first section transports said ions to said second section.

39. An apparatus according to claim 37, wherein said sampling device is conical.

40. An apparatus according to claim 37, wherein said apparatus sequentially and repetitively samples said ions from said plurality of sprayers.

41. An apparatus according to claim 37, wherein said plurality of sprayers are mounted symmetrically around an axis of said sampling device such that the positioning of said sampling device is substantially the same with respect to each of said plurality of sprayers.

42. An apparatus according to claim 37, wherein the shape of said first section of said multiple capillary device substantially conforms to the shape of said sampling device.

43. An apparatus according to claim 34, wherein said feedback device comprises at least one LED and at least one photodiode.

44. An apparatus according to claim 37, wherein said apparatus is used to introduce ions into one or more mass analyzers for subsequent analysis.

45. An apparatus according to claim 44, wherein said mass analyzers are selected from the group consisting essentially of a time-of-flight (TOF) mass analyzer, quadrupole (Q) mass analyzer, Fourier transform ion cyclotron resonance (FTICR) mass analyzer, ion trap mass analyzer, magnetic (B) mass analyzer, electrostatic (E) mass analyzer, ion cyclotron resonance (ICR) mass analyzer, and quadrupole ion trap mass analyzer.

46. An endcap electrode for use with a multiple section capillary for multiplexing a plurality of samples from a plurality of sprayers, said endcap comprising:

a circular electrode having a central aperture; and at least one slit extending radially from said central aperture for aligning with said plurality of sprayers;

wherein said endcap is mounted over a sampling orifice of a capillary tube, and wherein said endcap directs heated drying gas through said slits to dry droplets sprayed by said plurality of sprayers.

47. An endcap electrode according to claim 46, wherein an electric potential is applied uniformly between said endcap, said sampling orifice, and each of said plurality of sprayers to facilitate direction of ions into said sampling orifice.

48. An endcap electrode according to claim 46, wherein said endcap electrode further comprises a plurality of slits extending radially from said central aperture, and wherein each of said slits is positioned adjacent to one of said plurality of sprayers.

49. An improved method for multiplexing a plurality of samples from a plurality of sprayers into a mass analyzer through a multiple section capillary device to independently optimize the performance of each sprayer, said method comprising the steps of:

forming sample spray droplets from a plurality of sprayers;

desolvating said droplets in an electric field to form sample ions;

positioning an entrance end of a first flexible capillary section in alignment with a first of said sprayers to receive said sample ions to be transported into said mass analyzer; and transporting said sample ions into said mass analyzer through said multiple section capillary device.

50. An improved method according to claim 49, wherein said plurality of sprayers include ESI sprayers.

51. An improved method according to claim 49, wherein said plurality of sprayers include electrosprayers and pneumatic sprayers.

52. An improved method according to claim 49, wherein an endcap electrode directs heated drying gas onto said droplets to desolvate said droplets to form said sample ions.

53. An improved method according to claim 49, wherein at least one sampling device is used to select said sample ions.

54. An improved method according to claim 53, wherein said sampling devices are cylindrical.

55. An improved method according to claim 53, wherein said sampling device is planar to select said sample ions from said plurality of sprayers in a planar arrangement.

56. An improved method according to claim 49, said method further comprising the step of:

repositioning said entrance end of said first flexible capillary section in alignment with a second of said sprayers to receive a second group of sample ions to be transported into said mass analyzer.

57. An apparatus for multiplexing a plurality of samples from a plurality of ion production devices, said apparatus comprising:

a multiple section capillary having first and second sections joined by a union;

a sampling device having at least one aperture for accepting a first end of said first section of said capillary;

a motor for controlling movement of said sampling device;

a connecting rod for connecting said motor to said sampling device;

a feedback device; and an endcap electrode positioned between said ion sources and said sampling device;

wherein said first section of said capillary has at least one sampling orifice, wherein an exit end of said first section is coaxially and electrically connected to an entrance end of said second section, wherein said endcap electrode directs heated drying gas into a region between said sampling device and said endcap electrode, and wherein said motor rotates said sampling device to align with an aperture in said endcap electrode such that ions from each of said plurality of ion production devices maybe introduced into said sampling orifice.

58. An apparatus according to claim 57, wherein said capillary leads directly into a first vacuum region.

59. An apparatus according to claim 57, wherein said sampling device is conically-shaped.

60. An apparatus according to claim 57, wherein said apparatus is used to sequentially sample said ions from said plurality of ion production devices.

61. An apparatus according to claim 57, wherein an electric potential is established between said endcap electrode, said aperture and each of said plurality of ion production devices to facilitate transportation of ions through said aperture of said sampling device.

62. An apparatus according to claim 57, wherein said endcap electrode has a plurality of apertures and wherein the number of apertures in said endcap electrode corresponds to the number of said ion production devices being utilized.

63. An apparatus according to claim 57, wherein said rotation of said sampling device is continuous.

64. An apparatus according to claim 57, wherein said rotation of said sampling device is periodic such that said aperture of said sampling device is aligned with said ion production devices for a greater period of time than for said rotation of said sampling device.

65. An apparatus according to claim 57, wherein movement of said sampling device is controlled by an electronic controller.

66. An apparatus according to claim 57, wherein said plurality of ion production devices are mounted symmetrically around an axis of said sampling device such that the positioning of said sampling device is substantially the same with respect to each of said plurality of ion production devices.

67. An apparatus according to claim 57, wherein said entrance end of said first section substantially conforms to said aperture of said sampling device such that said entrance end of said first section is movably mounted in said aperture of said sampling device.

68. An apparatus according to claim 57, wherein said first section comprising a plurality of sampling orifices.

69. An apparatus according to claim 68, wherein each said sampling orifice receives ions simultaneously from at least one ion production device.

70. An apparatus according to claim 57, wherein said feedback device comprises at least one LED and at least one photodiode.

71. An apparatus according to claim 70, wherein said LEDs and said photodiodes are positioned to detect alignment of said sampling orifice with said sprayers.

* * * * *